US008358919B2

(12) United States Patent
Turner et al.

(10) Patent No.: US 8,358,919 B2
(45) Date of Patent: Jan. 22, 2013

(54) SUPER HEATED STEAM GENERATOR WITH SLACK ACCOMMODATING HEATING TANKS

(75) Inventors: Jimmy L. Turner, Las Vegas, NV (US); Richard B. Graibus, Las Vegas, NV (US)

(73) Assignee: Trimeteor Oil and Gas Corporation, Las Vegas, NV (US)

( * ) Notice: Subject to any disclaimer, the term of this patent is extended or adjusted under 35 U.S.C. 154(b) by 715 days.

(21) Appl. No.: 12/590,919

(22) Filed: Nov. 16, 2009

(65) Prior Publication Data

US 2011/0116775 A1 May 19, 2011

(51) Int. Cl.
*F22B 1/28* (2006.01)

(52) U.S. Cl. ..... 392/399; 392/386

(58) Field of Classification Search ..... 392/386–406
See application file for complete search history.

(56) References Cited

U.S. PATENT DOCUMENTS

| | | | | |
|---|---|---|---|---|
| 3,243,575 | A | | 3/1966 | Vignere, Sr. |
| 4,408,116 | A | | 10/1983 | Turner |
| 5,142,608 | A | | 8/1992 | Meshekow |
| 5,367,605 | A | * | 11/1994 | Violi ..... 392/401 |
| 5,949,958 | A | | 9/1999 | Naperkowski et al. |
| 6,094,523 | A | | 7/2000 | Zelina |
| 6,095,098 | A | | 8/2000 | Beal |
| 7,092,519 | B1 | | 8/2006 | Lindholm |

FOREIGN PATENT DOCUMENTS

| | | |
|---|---|---|
| MX | 97201 | 11/1968 |

* cited by examiner

*Primary Examiner* — Thor Campbell
(74) *Attorney, Agent, or Firm* — Stephen D. Carver

(57) ABSTRACT

A multi-stage, superheated steam generator for crude oil recovery comprises a plurality of radially spaced-apart first stage electric heating tanks that peripherally surround an inner, second stage electric steam tank. The steam tanks are secured within casing by a slack accommodating mounting comprising a downwardly projecting stub received within a rigid, tubular expansion sockets secured beneath each steam tank. A plurality of serpentine, electric resistive heating elements abut each steam tank. The elements have loop portions proximate the bottoms of each steam tank and vertical portions abutting each tank periphery. First stage tanks output steam to a manifold system that outputs to the second stage heater.

24 Claims, 21 Drawing Sheets

SUPER HEATED STEAM GENERATOR WITH SLACK ACCOMMODATING HEATING TANKS

BACKGROUND OF THE INVENTION

1. Field of the Invention

The present invention relates generally to high temperature steam generators for use in recovering crude oil of low specific gravity. More particularly, the present invention relates to enhanced steam generators using multiple heating stages to produce superheated steam.

2. Description of the Related Art

A variety of steam heaters and associated steam injection techniques have been proposed for recovering heavy crude oil deposits. It is well know in the art to inject high temperature steam within wells to decrease the viscosity of heavy crude oils, facilitating subsequent pumping and recovery. Injected steam warms the well bore, heating the piping, the casings and the environment. A recognized difficulty in the art relates to the generation of superheated steam at proper temperatures and volume. Injected steam must not only be of sufficient temperature and pressure to properly liquefy targeted crude oil within the well, but a sufficient volume of such steam is required during the injection process for success. In general, large volume demands mitigate against the successful operational maintenance of the requisite pressure and temperature of the applied steam.

Previously it has been known in the art to provide a steam heater with an internal tank positioned coaxially disposed within an outer shroud. It is known to use electric heating elements surrounded by lead disposed between the tank and the electrodes. As the lead melts from the heating elements, heat is transferred by the molten metal disposed about the steam vessel. This basic construction is shown in Mexican patent No. 97201, issued November 1968. However, with the latter device, steam output temperatures vary widely. Liquid levels within the input tank would vary constantly, resulting in irregular vaporization. Temperature fluctuation between Four Hundred to Sixteen Hundred Degrees F. were experienced, resulting in the inadvertent stopping of crude oil pumps in response to build-up of improperly heated steam.

Multiple stage steam generators for enhancing crude oil recovery are known in the art. U.S. Pat. No. 4,408,116 issued to Turner on Oct. 4, 1983 discloses a superheated steam generator with dual heating stages. The first stage comprises a plurality of radially spaced-apart heaters that surround an encircled, second stage heater. A primary manifold system supplies water to each of the first stage heaters via elongated tubes extending longitudinally interiorly of the first stage heater tanks. A rigid, tubular sheath coaxially surrounds and protects each of the last mentioned tubes, and defines a steam output passageway between the sheath and the mouth of each first stage tank. Steam from the first stage tanks is transmitted to the second stage tank by a plurality of conduits extending from first stage tanks to a central manifold feeding an encircled second stage tank.

Experiments have continued over the years with apparatus constructed in accordance with prior U.S. Pat. No. 4,408,116 mentioned above. As the price of crude oil increases, more and more efforts have been undertaken to recover deposits from domestic wells. However, one common weakness in prior devices has been the inability to reliably and virtually continuously generate and deliver a high volume of pressurized, superheated steam at temperature approximating 1200 degrees F. One problem has been experienced with the electrodes used to heat internal vaporization tanks, and with other critical components. Wide temperature variations are encountered in use. Prior to energization, for example, the component temperature is that of the environment, i.e., ambient temperature. After heating commences, a temperature rise in excess of 1000 degrees F. occurs. Because of the resultant expansion of the metal components, and the various different coefficients of expansion that characterize parts of different substances, extreme stresses occur, as part dimensions increase and pressure and temperature rises.

The stress problem has caused heater tank failure in the past, necessitating frequent time consuming and expensive field repairs. For example, because of the traditional mounting techniques used for high temperature tanks, that are bathed within liquid lead during operation, tank cracking and deformation have been unavoidably frequent. These problems have been aggravated by the prior art configuration of internal electrodes used for heating the critical tanks. The proposed solution in part utilizes a new electrode configuration, combined with a flexible tank mounting configuration.

Furthermore, to reach operating temperatures approximating 1200 degrees F., the water and steam injection pathways must be carefully controlled, and energy must be conserved. While various prior art steam injection heaters have utilized piping arrangements establishing fluid flow in thermal, heat exchange relation, an adequate high temperature, superheated steam injection system must employ manifolding that is designed to conserve energy by minimizing fluid-blocking back-pressures, that are characteristic of prior art designs. Further, the entire fluid flow path must be capable of non-destructively, mechanically adapting in response to heat-induced expansions and later down-time contractions. The latter factor is particularly important with the flexible, slack-accommodating mounting of the heater tanks proposed by the instant invention, and with the chosen electrode configuration, the use of which has been enabled by said heater tank mounting arrangement.

BRIEF SUMMARY OF THE INVENTION

The present invention comprises a two-stage steam generator for generating and outputting large volumes of superheated steam at high pressures. The generator comprises a plurality of radially spaced-apart first stage heaters which feed a centrally disposed, second stage heater through an enhanced manifold system utilizing maximal heat exchange mechanical relationships. Each peripheral first stage heater comprises an inner, generally cylindrical tank surrounded by a substantially coaxially positioned casing. A meltable preferably metallic heat transfer substance, i.e., lead, is disposed between the casing and the tank, and is melted by one or more electric heating elements disposed in part in a spiraled arrangement below each tank bottom. Heat is distributed evenly about the bottom and periphery of the inner tanks to generate steam in response to thermal contact of the tank with the liquid lead.

Importantly, the heater tanks are disposed in a non-rigid position capable of mechanically expanding and moving in response to the severe heat. Because different substances possess different coefficients of hear expansion, the flexible mounting accommodates expansion with sufficient "slack", preventing cracking or critical deformation. It is preferred that each heater tank include a lower standoff that projects downwardly towards the enclosure bottom. A rigid, generally cylindrical, receptor that is affixed to the enclosure bottom coaxially receives and generally centers the standoff. As the lead bath heats, mechanical movements of the tank relative to the receptor are permitted, while potentially destructive excess movements of the heated tanks are minimized.

The above described flexible slack accommodating mounting arrangement permits the deployment of enhanced heater coils immediately beneath the tanks, in a partially spiraled configuration proximate the generally convex tank bottom. Heat in excess of that previously generated in commercially viable superheated steam systems is thus produced, without the characteristic component "hot spots". As is well recognized, lead is a dangerous substance if not properly handled. Lead melts at approximately 621 degrees F. When molten, it releases minute amounts of vapors at a progressive rate as temperatures are increased. Harmful levels of lead vaporization are believed to occur at elevated temperatures above 1800 degrees (F.). While lower temperatures between 700-800 degrees are normally needed for casting lead parts, in superheated steam generators temperatures approximating 1000 degrees F. are desired. If particular hot-spots develop, i.e., lead-immersed parts approach 1800 degrees F., dangerous lead vaporization can occur. As the target output temperature contemplated with the present design is approximately 1200 degrees F., improper heating coil arrangements can generate impermissible lead vapors where hot spots are produced.

Thus prior art heater element designs that can produce hot-spots are to be avoided. Further, the characteristic component expansions and/or contractions that result in component degradation characterizing previous systems are to be avoided. As a result of the instant construction, hot-spots from irregular heat transfer are avoided. Furthermore, component break down is minimized, and expensive, time-wasting field repairs are substantially minimized.

Each of the first stage heater tanks receives water through a manifold system. The manifold includes a central reservoir, and a plurality of output passageways provided in communication therewith. An input conduit leading to each first stage tank is coupled to the output passageways, establishing a critical heat exchange needed for efficient high temperature, high volume operation. A unique flow construction design handles interstage transmission of steam and water. Steam outputted from each of the first stage generators is distributed via a spoke-like network of conduits, terminating in a second stage steam manifold, which injects heated steam interiorly of the second stage heater, that generates superheated steam from the incoming relatively low temperature steam, which may then be forced to an external application within a crude oil well or the like.

Thus an object of this invention is to provide a superheated steam generator for use in recovering crude oil that maintains high output temperatures while outputting large volumes of superheated steam.

Another basic object of this invention is to provide a superheated steam heater whose tanks are slack-accommodated.

Another important object is to provide a tank mounting arrangement for superheated steam generators that non-destructively accommodates heat expansion and contraction.

A related object is to provide a unique electrode configuration that efficiently heats the tanks non-destructively, while minimizing hot spots.

It is also an object to minimize vaporization of the liquid lead used to maximize heat transfer.

Another important object of our invention is to maintain a steady state flow through the assembly. It is a feature of our invention that the conditions at any point in the system will not change as a function of time. Also the flow rate of water will remain approximately the same throughout the assembly.

Another object of the present invention is to provide a superheated steam generator of the character described that outputs relatively large volumes of superheated steam at a temperature of approximately 1200 degrees F.

Yet another object is to provide an enhanced heater electrode configuration that is failure resistant.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout to indicate like parts in the various views.

DETAILED DESCRIPTION OF THE INVENTION

Figure 1:
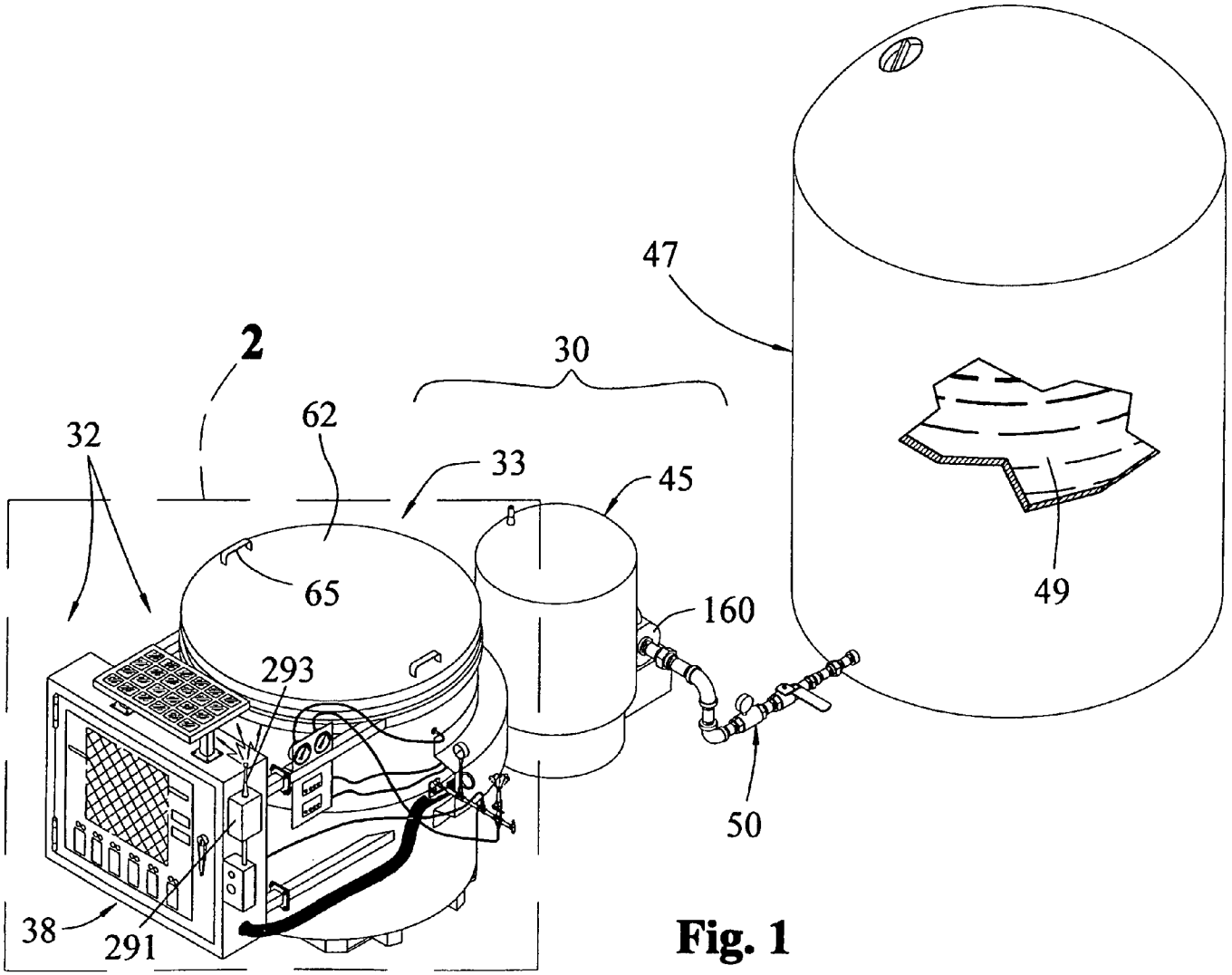
FIG. 1 is a diagrammatic isometric view of a superheated steam generator constructed in accordance with the best mode of the present invention, with parts thereof broken away or shown in section for clarity.
Figure 2:
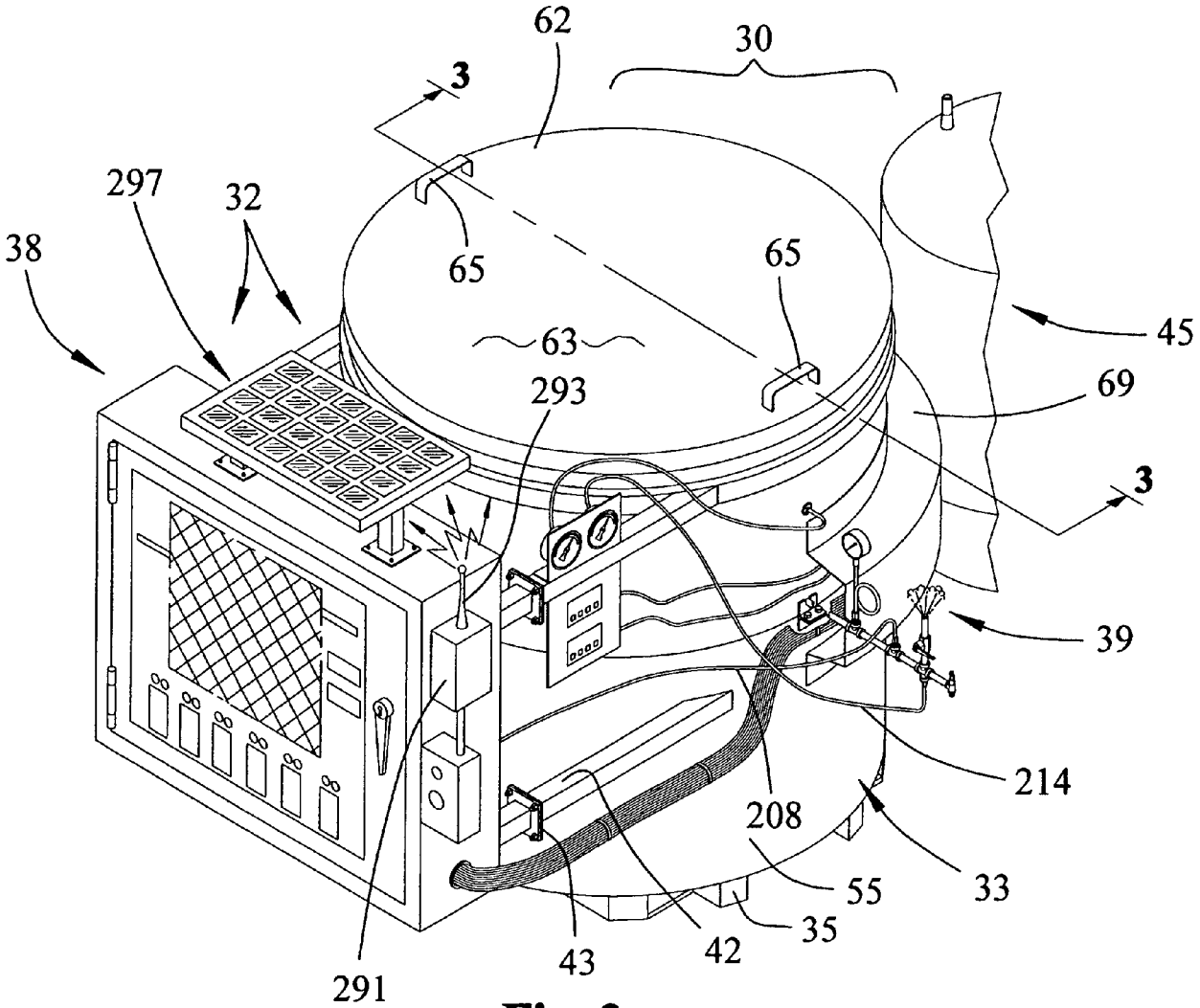
FIG. 2 is an enlarged, isometric view of the steam generator derived from rectangular region 2 in FIG. 1, with portions thereof broken away or shown in section for clarity.
Figure 3:
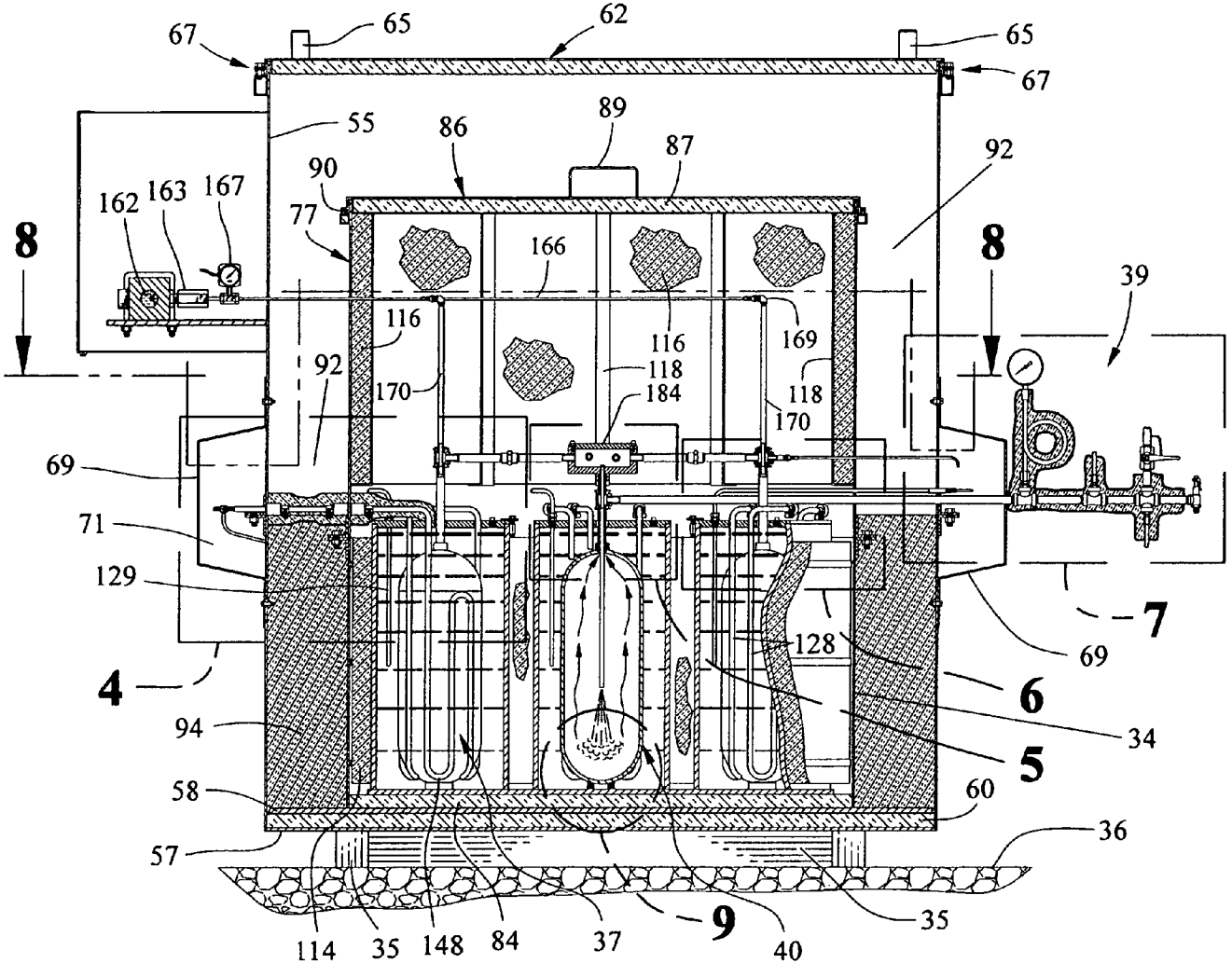
FIG. 3 is an enlarged sectional view of the steam generator taken generally along line 3-3 of FIG. 2, with portions thereof omitted for brevity.

With initial reference directed to FIGS. 1-4 of the appended drawings, a superheated steam generator system constructed generally in accordance with the best mode of the invention has been generally designated by the reference numeral 30. The illustrated system comprises a multi-stage superheated steam generator 32 having an upright, generally cylindrical containment vessel 33 that protectively encloses steam tank shroud 34 disposed concentrically therewithin. Supporting feet 35 rest upon a level, supporting surface 36 (FIG. 3). Suitable surfaces include the bed of a truck during portable operation, a prepared, reinforced level slab 41 (i.e., FIG. 12A), a remote platform or the like. A plurality of first stage steam tanks 37, preferably six, are radially spaced apart about the periphery of a center, second stage steam tank 40 within shroud 34. The system is operated by an associated control console 38 (FIG. 1), the housing of which is generally in the form of a parallelepiped. Console 38 is secured by rigid support rails 42 extending from the containment vessel 33 by mounting flanges 43. As later described in conjunction with FIGS. 12A and 12B, supply water is supplied to first stage heaters within containment vessel 33 from a water supply tank 45 that is supplied by a large capacity reservoir 47 (or other high volume water source) filled with supply water 49. A conventional low pressure supply conduit 50 (FIG. 1) from reservoir 47 communicates with supply tank 45. As explained hereinafter, superheated steam is outputted from the second stage heater through discharge assembly 39 best illustrated in FIG. 7.

Figure 4:
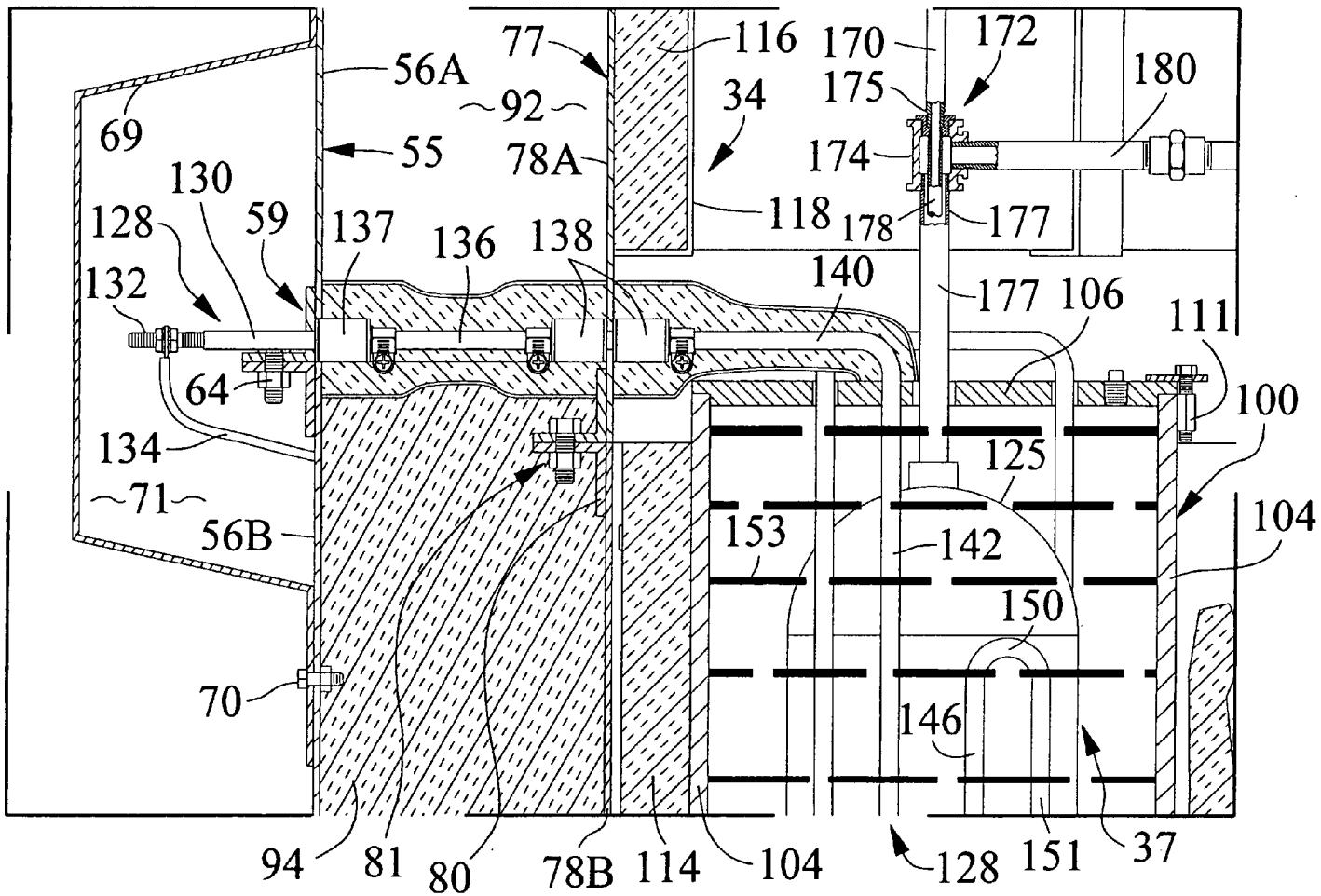
FIG. 4 is an enlarged sectional view taken generally from rectangular, boldly numbered region 4 in FIG. 3, showing a first stage steam tank and related components.

With primary reference directed to FIGS. 2 and 3, the containment vessel 33 has a rigid, generally cylindrical, stainless steel tubular body 55 extending upwardly from a lower floor 57. An internal subfloor 58 disposed above floor 57 (FIG. 3) with an insulation layer 60 sandwiched therebetween. The spaced apart feet 35 attached beneath floor 57 and resting upon surface 36 provide support. The cylindrical containment vessel body 55 is capped by a circular cover 62 removably disposed on top of containment vessel 33. As best seen in FIG. 4, the containment vessel body 55 comprises upper and lower cylindrical segments 56A and 56B respectively that include abutting flanges 59 compressively secured by suitable fasteners 64 (FIG. 4). The exposed, circular upper surface 63 (FIG. 2) of the cover 62 has suitable handles 65. Cover 62 is secured in place atop containment vessel body 55 by conventional latches 67 (FIG. 3). Preferably, a generally toroidal guard 69 circumscribes the external periphery of the cylindrical body 55 to protect various electrical lines, plumbing and miscellaneous cables and parts. Guard 69 is mounted to body 55 of containment vessel 33 with suitable fasteners 70 (FIG. 4). The annular void between guard 69 and body 55 houses various components such as the high voltage cable and electrode conduits seen to the left of FIG. 4.

A generally cylindrical steam tank shroud 34 is disposed concentrically within containment vessel 33, centered above subfloor 58 (FIG. 3). Shroud 34 comprises an upright, generally cylindrical two piece body 77 comprising rigid upper and lower halves 78A, 78B respectively that are secured together with abutting flanges 80 secured by fasteners 81 (FIG. 4). The lower body half 78B rests upon a support plate 85 (FIG. 9) disposed over a lower, circular insulation layer 84 overlying subfloor 58 of containment vessel 33 (i.e., FIGS. 3, 9). The upper shroud body half 78A of steam tank shroud 77 is capped by a circular cover 86, which preferably supports an insulation layer 87 at its underside. Handle 89 aids in manipulating cover 86, which is semi-permanently secured atop the shroud 34 by suitable latches 90 (FIG. 3). Preferably the interior annular space 92 (FIGS. 3, 4) between the containment vessel 33 (i.e., its body 55) and the steam tanks shroud 34 is substantially filled with insulation 94 for heat conservation.

Figure 5:
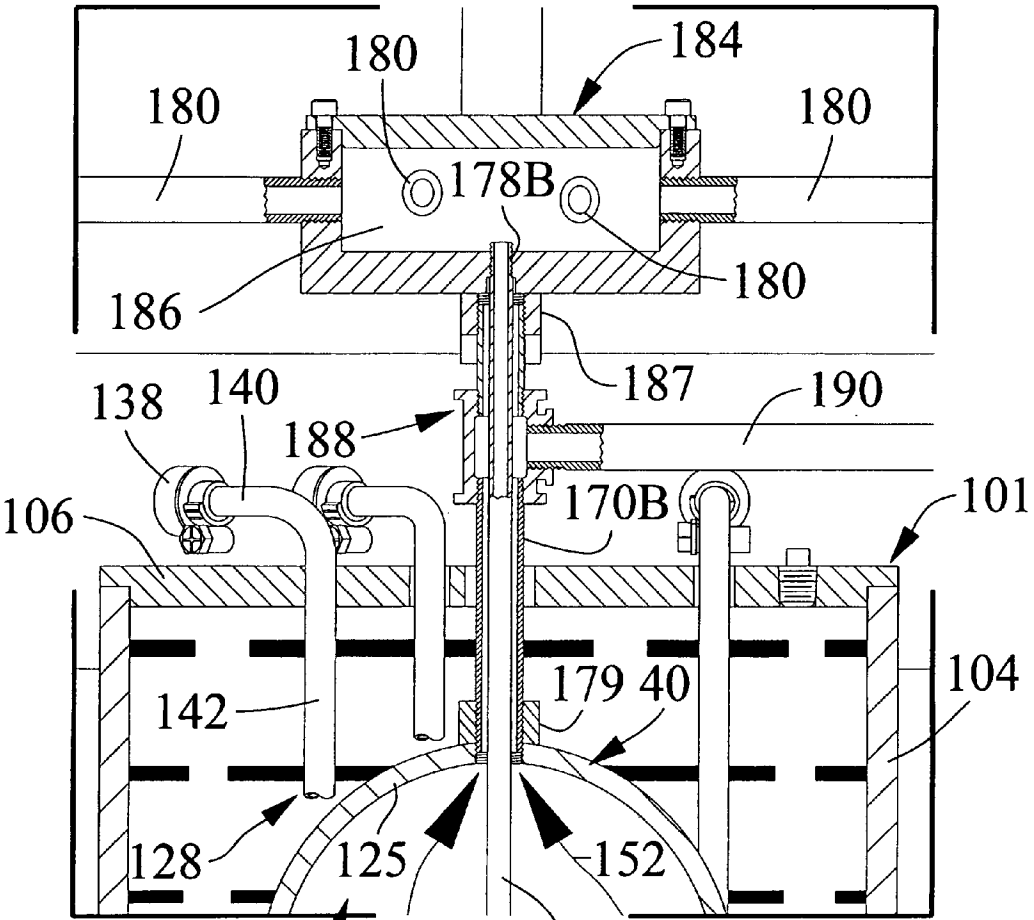
FIG. 5 is an enlarged sectional view taken of the upper regions of a heating tank taken generally from rectangular, boldly numbered region 5 in FIG. 3, and showing the, centrally located, second stage superheated steam tank and related structure.
Figure 6:
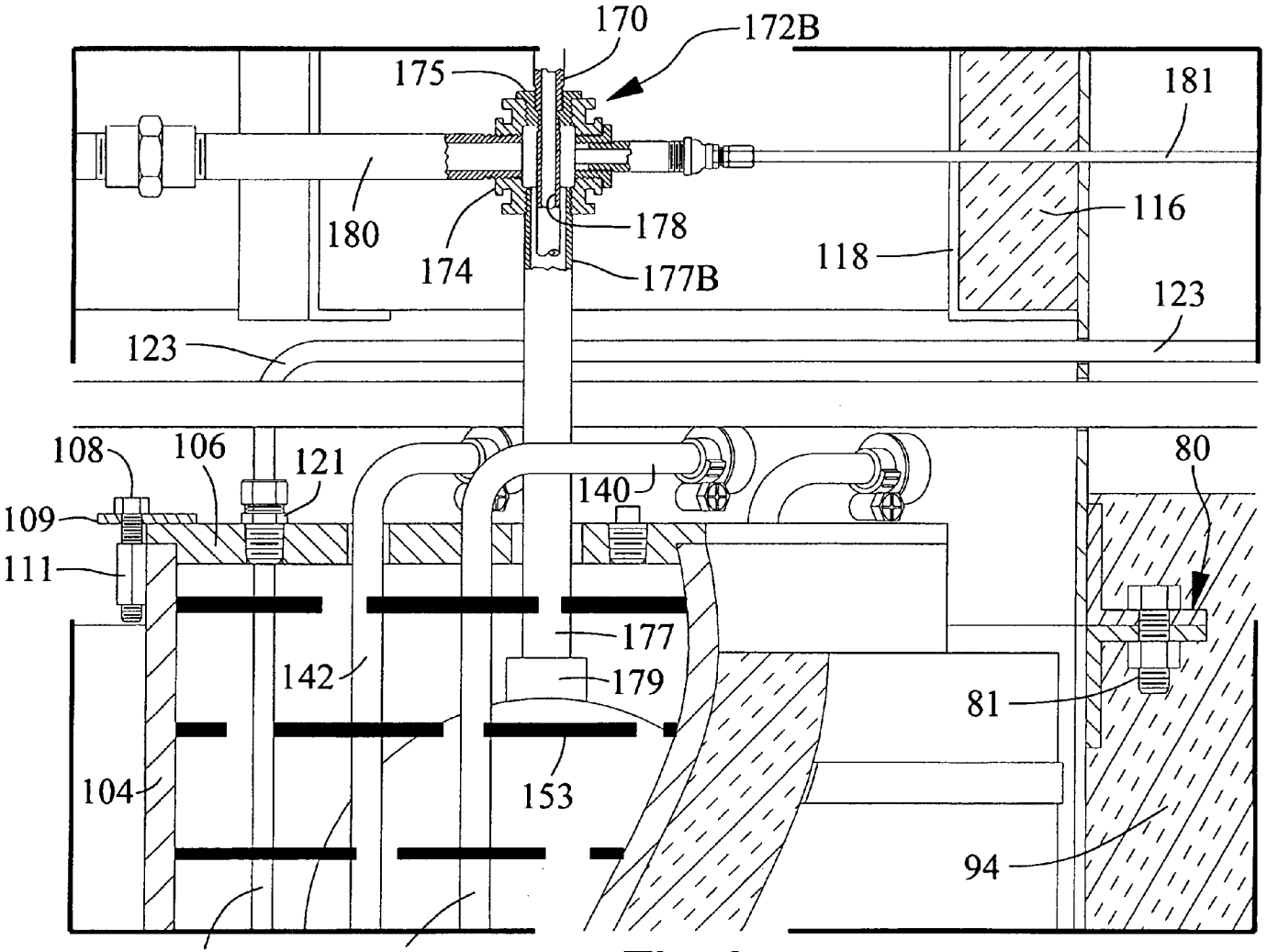
FIG. 6 is an enlarged sectional view taken generally from rectangular, boldly numbered region 6 in FIG. 3, showing preferred tank outlet connections.

With reference directed to FIGS. 3, 5 and 8-10, the steam tanks 37, 40 are tightly disposed within a heat exchange array within shroud 34. The first stage heater assembly comprises a plurality of first stage steam tanks 37 disposed within rigid, hexagonal casings 100 that are radially spaced apart around a second stage heart assembly. The second stage heater assembly comprises a steam tank 40, which is disposed within a casing 101 configured similarly to surrounding casings 100. The radially spaced apart peripheral casings 100 touch one another, and all touch the central casing 101 for promoting thermal efficiency. The hexagonal configuration enables the mutual touching preferred for maximum heat exchange. As best seen in FIGS. 4-6, each hexagonal steam tank casing 100, 101 has a plurality (i.e., six) of generally rectangular, peripheral side panels 104 that are covered by a hexagonal top plate 106. The edges of the top plate are secured to the lower panels with suitable bolts 108 (FIG. 6) that penetrate a flange 109 and are threadably secured within suitable sockets 111 disposed about the casing periphery. As best seen in FIG. 4, insulation 114 is disposed between the somewhat annular void formed by the hexagonal casings 100 surrounding each first stage steam tank 37 and the inner periphery of the two piece shroud body 77. Preferably an upper mass of insulation 116 (i.e., FIGS. 3, 4) is disposed at the upper peripheral edges of the shroud 34, being secured by a toroidal retainer 118. As appreciated from FIGS. 4 and 6, for example, a plurality of passageways are defined in the hexagonal cover plate 106 for transmitting fluids in and out of the steam tanks and for conduction electricity to various heater elements described later.

The first stage steam tanks 37 are centered within their hexagonally profiled, radially spaced apart casings 100, and the central steam tank 40 is likewise centered within its central casing 101. The rounded tops 125 (i.e., FIGS. 4, 5) and bottoms 126 (FIG. 9) of each steam tank are each arcuate and convex. The peripheral body of each steam tank is cylindrical in the best mode. As described later, water is injected interiorly of each first stage steam tank 37, and steam is outputted therefrom and injected interiorly of the second stage steam tank 40 via piping discussed hereinafter. Tank 40 outputs superheated steam as discussed in detail hereinafter. Each steam tank is heated by a trio of somewhat serpentine, electric resistive heating elements 128 (FIGS. 4, 5, 11) that substantially surround the periphery of the steam tanks 37, 40. For heating control each steam tank includes an on-board thermocouple 129 (i.e., FIGS. 6, 8) that is disposed within the hexagonal steam tank casing and the steam tank within the liquid lead therebetween. As best seen in FIG. 6, each thermocouple 129 (i.e., one for each steam tank 37 and/or 40) is coupled through the hexagonal top plate 106 via bushing 121 and leads outwardly through a line 123 for remote monitoring.

With reference now to FIGS. 3, 4, 8 and 11, power is conducted to electric heating elements 128 via horizontally oriented conductors 130 (FIG. 4) that are routed through containment vessel 33 and enters the annular void space 71 defined between guard 69 and containment vessel 33. A threaded terminal end 132 is bolted to a high voltage electrical conductor 134 whose opposite end is similarly electrically terminated. A horizontally disposed link 136 extends through insulated axial couplings 137 and 138 to a horizontal heater element segment 140 (FIGS. 4, 5) that is integral with an elongated, vertically downwardly extending heater element portion 142 (FIGS. 4, 11) that abut the periphery of the steam tanks. The two-piece coupling 138, that accommodates thermal contraction and expansion, penetrates the upper wall of the two-piece steam tank shroud body 77 (FIG. 4).

Each heater element 128 is generally of a serpentine construction, with a geometry adapted to flushly nest proximate the body of the steam tanks for maximum heat transfer. The vertical portions 142 (FIG. 11) of each heater element 128 extend down the sides of the steam tanks and terminate in inwardly deflected, arcuate bottom loops 148 (FIG. 9-11) disposed adjacent the steam tank bottoms 126. Several such heater element loops 148 are flushly located about the convex periphery of tank bottoms 126 (FIG. 10). An opposite end of the loop may extend vertically upwardly with a segment 146 (FIG. 4) abutting the steam tank sides. Segment 146 folds or curves backwards, forming an upper curved loop 150, integral with downward segment 151 that runs in serpentine fashion down the tank side to another heater element loop 148A (FIG. 11). Another vertical heater element segment 154 (FIG. 11) extends upwardly to a horizontal input potion 156 of the heating element 128.

The curved heater element loops 148 or 148A (FIG. 11) are preferred for the enhanced heating effects of the apparatus. Preferably the heater elements are powered with three-phase, 480 volt A.C. As heating occurs from the heater elements 128, lead filling the void between the steam tanks and the inner periphery of the heater containment shrouds 34 melts. In operation liquid lead, represented by shade lines 153 (FIGS. 4, 6) heats rapidly, becomes molten, and distributes heat evenly about the steam tanks due to the preferred construction of the serpentine and looped heater elements 128 (i.e., FIGS. 10, 11). Heat transfer is optimized by the interior insulation (i.e., 94, 114 in FIG. 4) disposed in interstitial spaces discussed previously. Steam generation is enhanced by the heater element loops 148, 148A (FIGS. 10, 11) placed immediately below the convex steam tank bottoms in the best mode.

As a consequence, high pressure steam indicated generally by the reference numeral 152 (FIG. 9), is formed within the steam tanks. Steam generated within the first stage, radially spaced apart steam tanks 37 is delivered to the central steam tank 40 for the generation and accumulation of superheated steam. Since the hexagonal casings of the steam tanks are mutually abutting, and thus disposed in heat exchange relationship while surrounded by insulation, an even thermal distribution results, and reliable high volume steam production follows.

Because of the extreme heat involved in operation, and the substantially even heat distribution afforded by the previously mentioned construction, extreme expansion and contraction of the various parts occurs. To prevent breakage, several refinements are preferred, For example, as mentioned previously, the containment vessel 33 is two piece, involving separate upper and lower halves held together by abutting flanges 59 (FIG. 4) discussed earlier. Likewise, the cheater containment shroud 34 is two piece as discussed earlier. Importantly however, the steam tanks are allowed to "float" within their hexagonal casings in response to the liquid lead therewithin. They can move slightly sideways, and up and down. Also, the couplings 137, 138 (FIG. 4) allow for thermal expansion and contraction of the 480-volt heater element connections.

Figure 9:
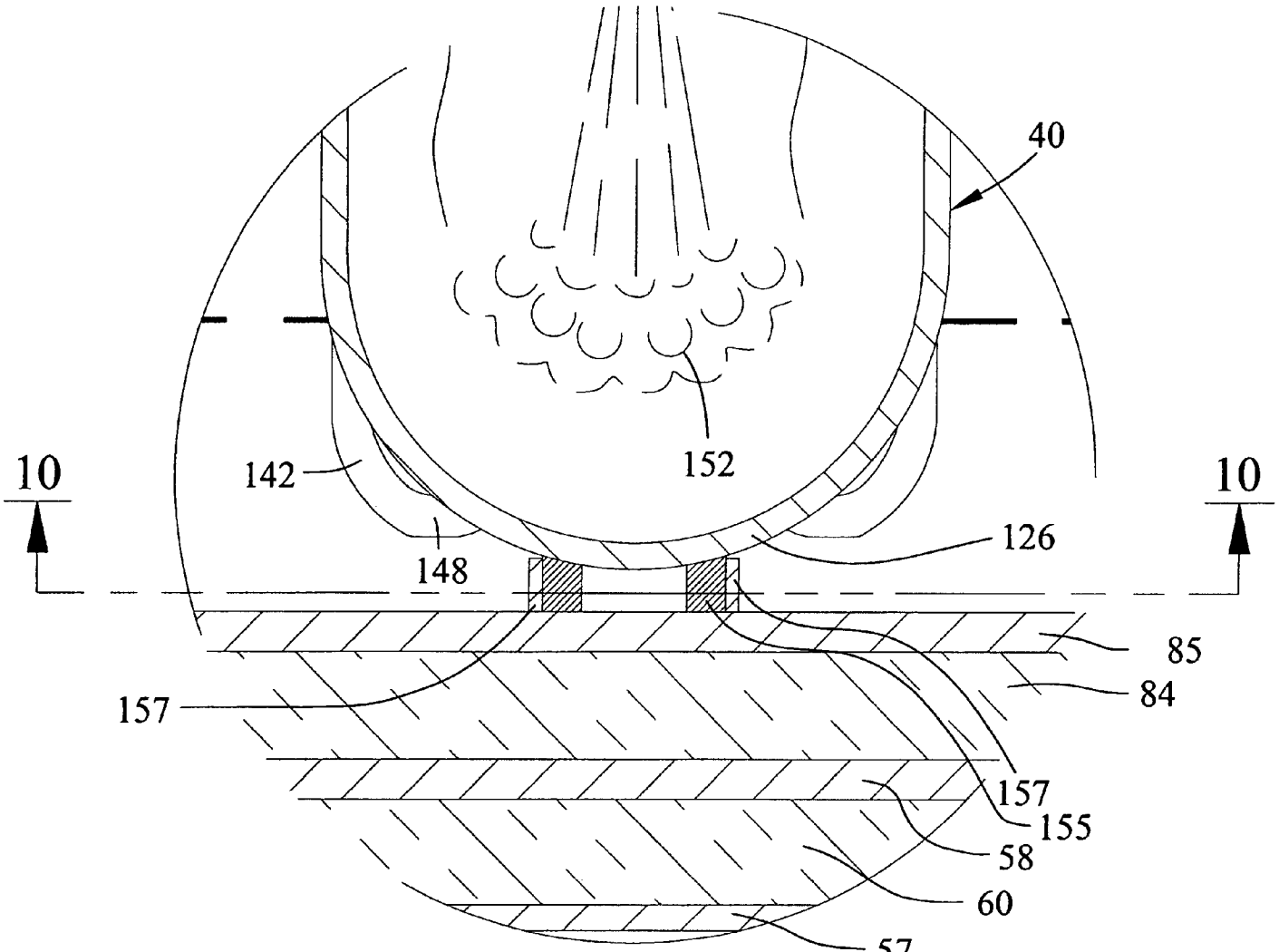
FIG. 9 is an enlarged sectional view derived from circular, boldly numbered region 9 in FIG. 3, with portions thereof omitted for clarity.
Figure 10:
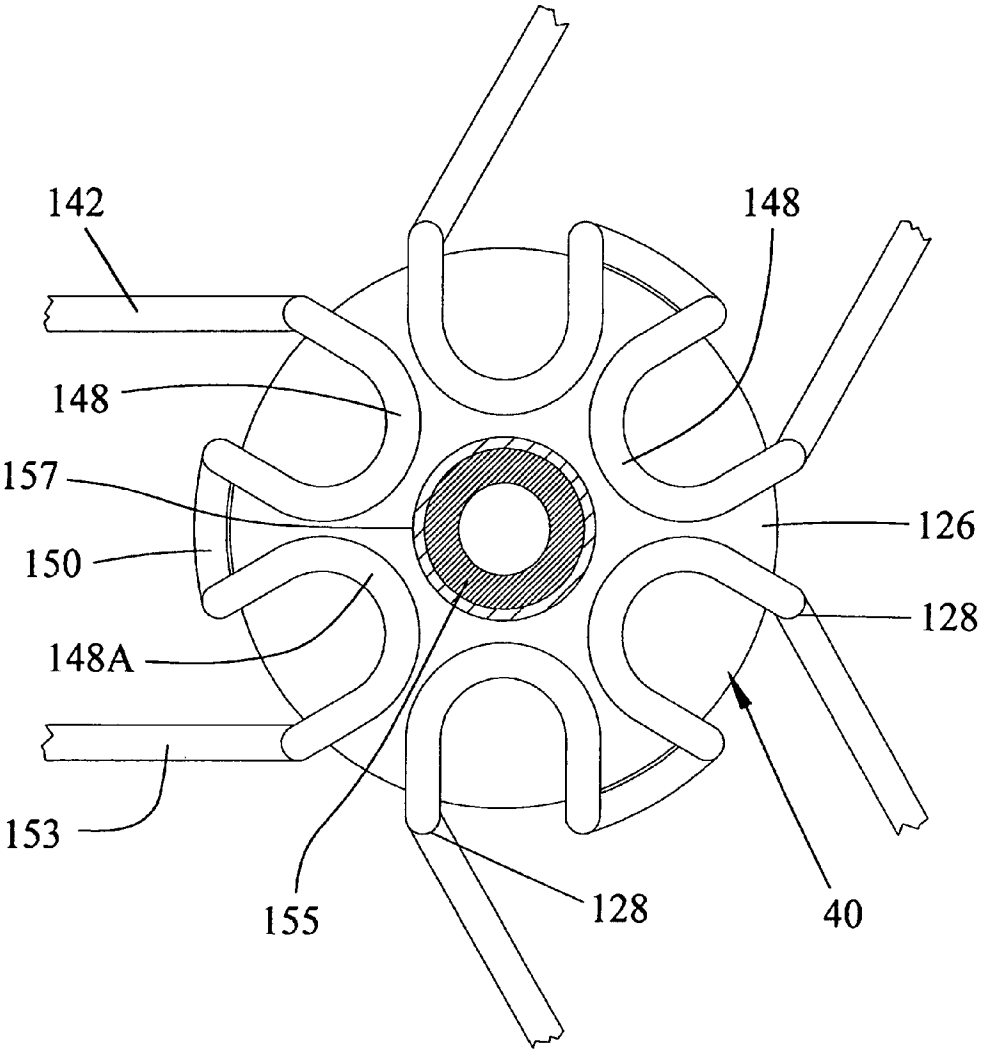
FIG. 10 is a sectional view taken generally along line 10-10 in FIG. 9 showing the heater element configuration preferred near the heater tank bottoms.
Figure 11:
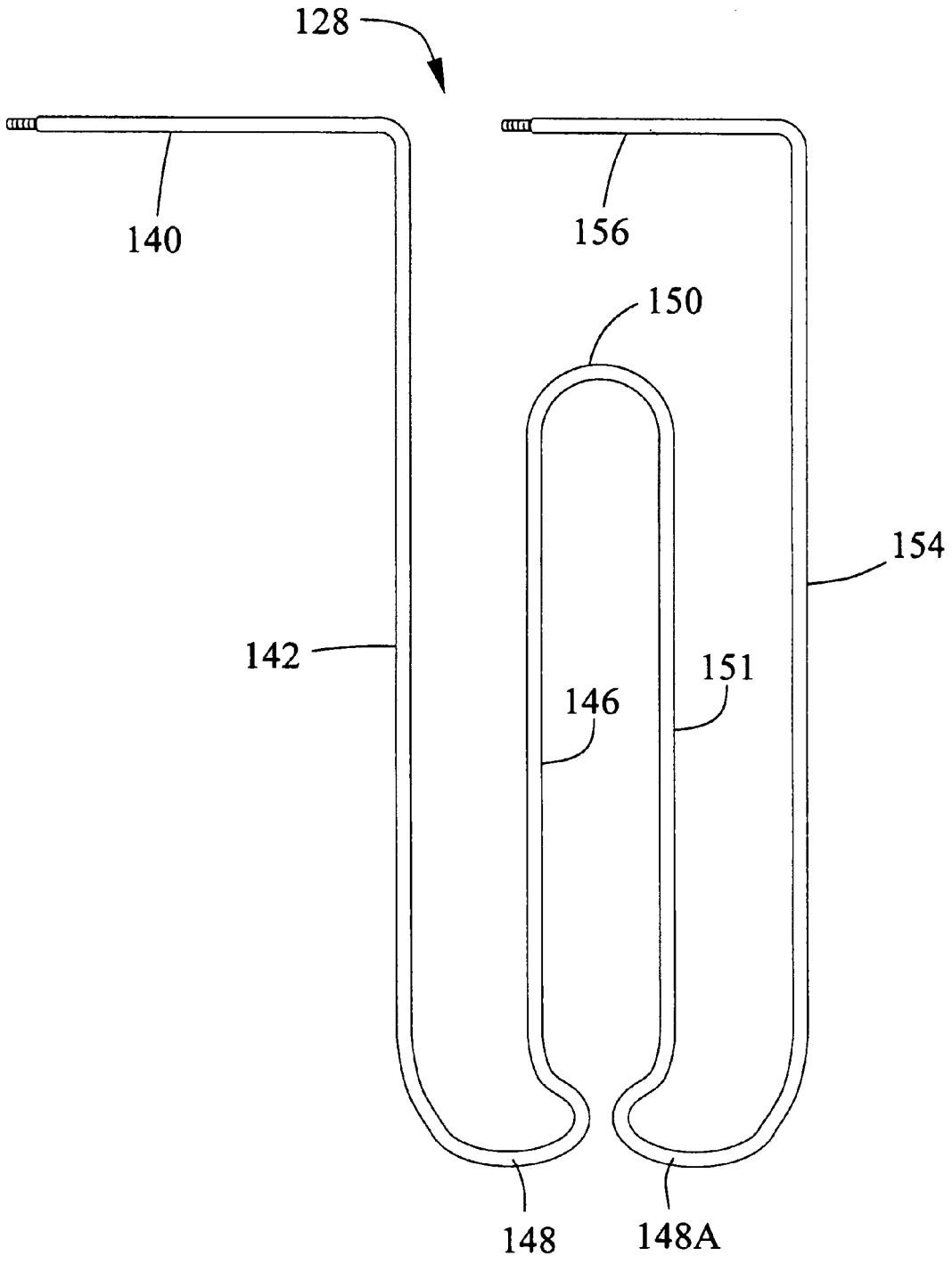
FIG. 11 is an isometric view of a typical electrically resistive heater element.

As best seen in FIGS. 9 and 10, a dynamic, slack-accommodating tank mounting arrangement is employed to accommodate tank movements resulting from thermal expansion and contraction. As viewed in FIG. 9, the convex bottom 126 of each steam tank has a short, downwardly projecting, tubular stub 155 welded to it. Each stub 155 is of a circular profile (FIG. 10) and it extends downwardly beneath the center of the tank bottom 126 (FIG. 9) towards the plate 85. In assembly each tank stub 155 is coaxially centered within and coupled to a rigid, tubular expansion socket 157 secured to lower plate 85 (FIG. 9). While limited sideways deflections of the steam tanks are allowed, it is clear that axial displacements caused by thermo contraction and/or expansion effects are accommodate axially. In other words, as the hot lead surrounding each steam tank heats up and melts during operation, or later contracts during cooling and solidification when the apparatus is not in use, the tanks can move slightly upwardly or downwardly to prevent breakage and accommodate thermally induced effects.

In operation, each of the first stage steam tanks 37 receives relatively cool water, and outputs steam. Steam from all of the first stage tanks is collected, and routed to the second stage steam tank 40, which then generates and outputs superheated steam. Water from reservoir 47 (FIG. 1) or other supply source is suctioned via supply conduit 50 and pump 160 (FIGS. 1, 12A) and forced under pressure into pressure tank 45 (FIG. 1). Pressurized water is outputted by tank 45 through pipe 162 (FIG. 3), expansion-accommodating bushing 163, to a tank input line 166 that feeds all of the first stage tanks. Input pressure is monitored by gauge 167 (FIG. 3). Line 166 leads to a plurality of unions or elbows 169 (FIG. 3) that route water downwardly via vertical conduits 170 to the various first stage steam tanks, which both receive water and discharge steam through a single upper bushing.

Each conduit 170 leads downwardly to a plurality of three-way, flow divider junctions 172 (FIG. 4) and a four-way flow-divider junction 172B (FIG. 6). Junctions 172, 172 provide separate flow paths for incoming fluid (routed downwardly into the interior of steam tank below) and higher temperature steam traveling upwardly out of the tank below. Each junction 172, 172B has a tubular body capped on top by a threaded bushing 175 connected at its bottom to a larger diameter pipe 177. A reduced diameter water inlet pipe 178 (FIG. 6) feeds through junctions 172 or 172B and extends coaxially through larger pipe 177 downwardly into the interior of each first stage steam tank. Second stage steam tank 40 is fed with steam from other tanks through the same type of apparatus involving pipe 178B (FIG. 5). Cap 179 on tank 40 (FIG. 5) is typical. A larger diameter pipe 177 (FIGS. 4, 6) threadably mates with the tank top at cap 179. Its interior is coaxially penetrated by lower diameter pipe 178 (i.e., FIG. 5) reaching the tank's interior that delivers water to the first stage tanks and stream to the second stage tank.

Steam resulting in the tanks is routed upwardly through cap 179 between the annulus between pipe 177 and internal pipe 178. The annulus in flow divider junctions 172 or 172B associated with each first stage steam tank conducts steam within an annulus between pipes 178 and 177 (FIGS. 4, 6). Each first stage steam tank routes steam through its flow divider junction 172 (FIG. 4) or 172B (FIG. 6) via high pressure steam pipes 180 (FIGS. 4 and 6) that extend towards the center of the second stage steam tank 40 (FIG. 8) in a spoke-like array, all leading to a steam manifold 184 (i.e., FIGS. 5, 8) that feeds second stage steam tank 40 with preheated steam. Flow divider junction 172B (FIG. 6) additionally connects to a purge line 181.

Steam within the interior 186 of steam manifold 184 (FIG. 5) is routed through feed pipe 178B that penetrates a fitting 187 and a three-way flow divider 188 similar flow divider 172 discussed earlier. Pipe 178B travels coaxially within pipe 170B, delivering steam interiorly of the second stage steam tank 40. Superheated steam generated in tank 40 travels through the annulus in cap 179 and the annulus within flow divider 188, and is outputted on high pressure, super-heated steam outlet pipe 190 (FIG. 5).

Figure 7:
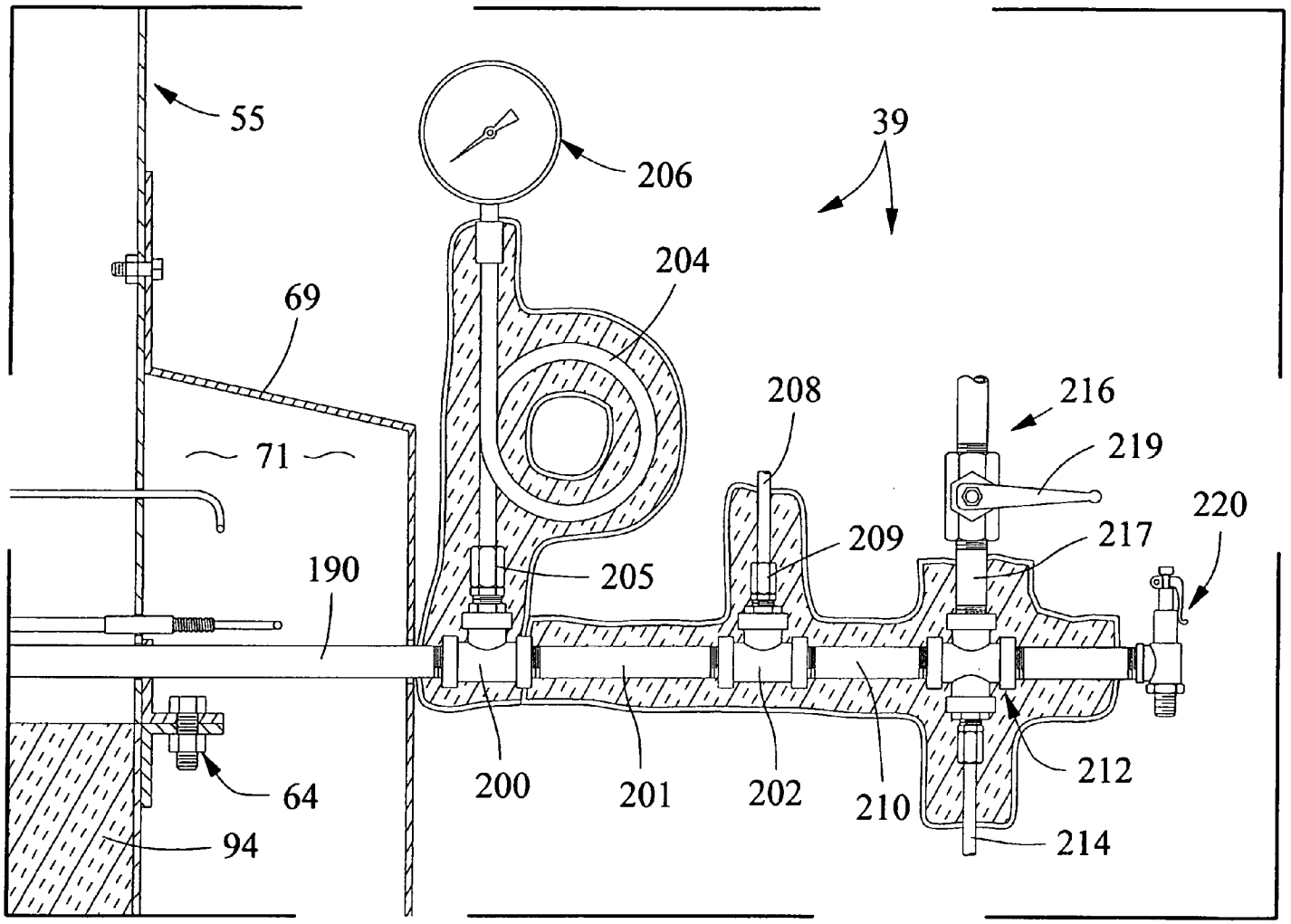
FIG. 7 is an enlarged sectional view taken generally from rectangular, boldly numbered region 7 in FIG. 3.
Figure 8:
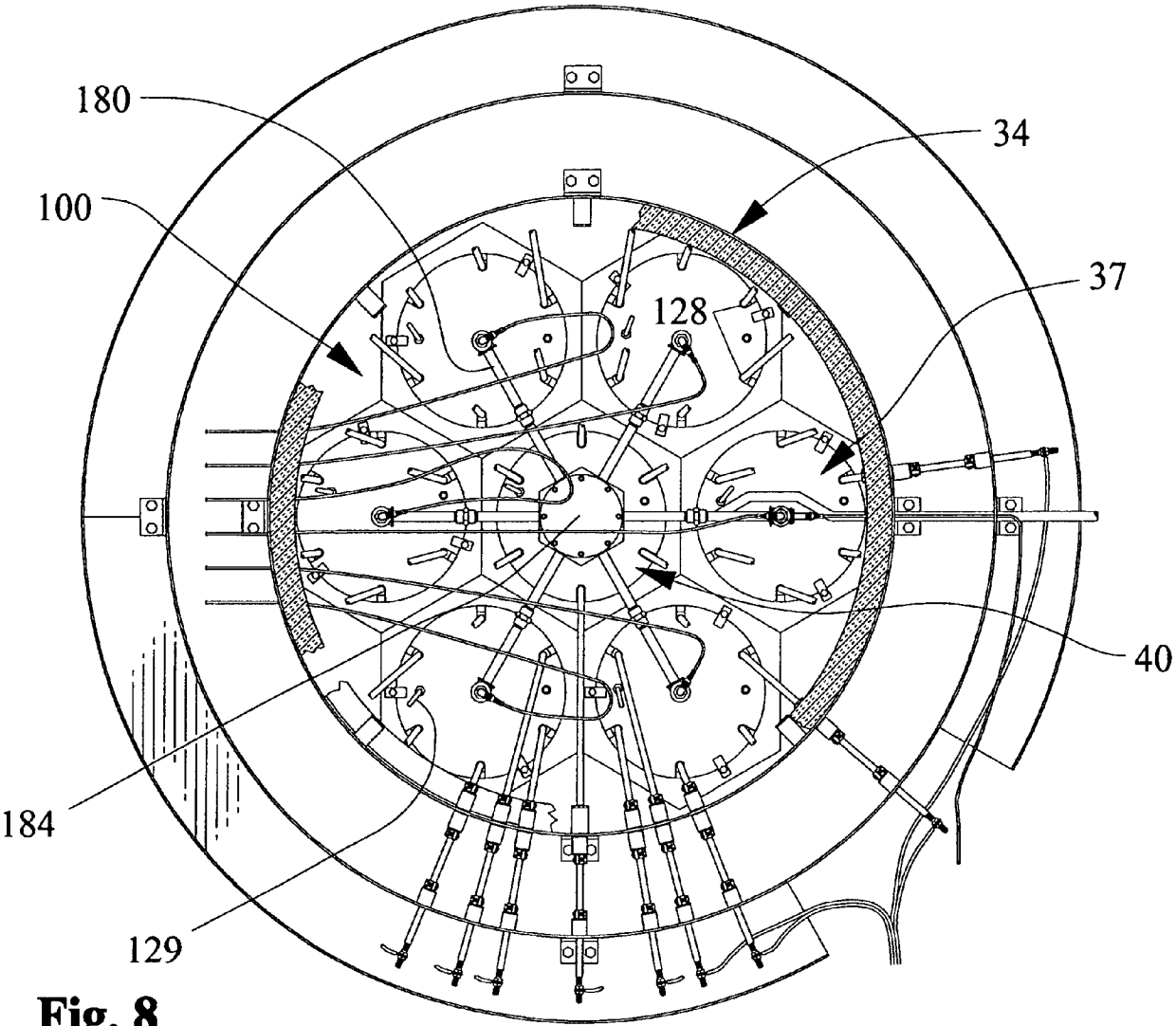
FIG. 8 is an enlarged sectional view of the high temperature steam generator output manifold arrangement, taken generally along line 8-8 of FIG. 3.

Referencing FIG. 7, the high pressure, superheated steam pipe 190 exits the wall 55 of containment vessel 33 through the peripheral guard 69 and enters the superheated steam discharge assembly 39. Pipe 190 threadably engages a three way T-fitting 200 that is connected via pipe 201 to another three-way T-fitting 202. A coiled line 204 extending upwardly from bushing 205 on top of fitting 200 leads to a pressure monitor gauge 206. A thermocouple line 208 is attached atop fitting 202 with bushing 209. Another pipe 210 extends from fitting 202 to a four-way fitting 212. High pressure relief is enabled in fitting 212. A downwardly extending pipe 214 leads to instrumentation described later for monitoring output pressure. Flow control valve 216 connected to fitting 212 via pipe 217 can be opened for steam discharge via handle 219. Overpressure relief venting is enabled through terminal fitting 220 (FIG. 7).

Figure 12A:
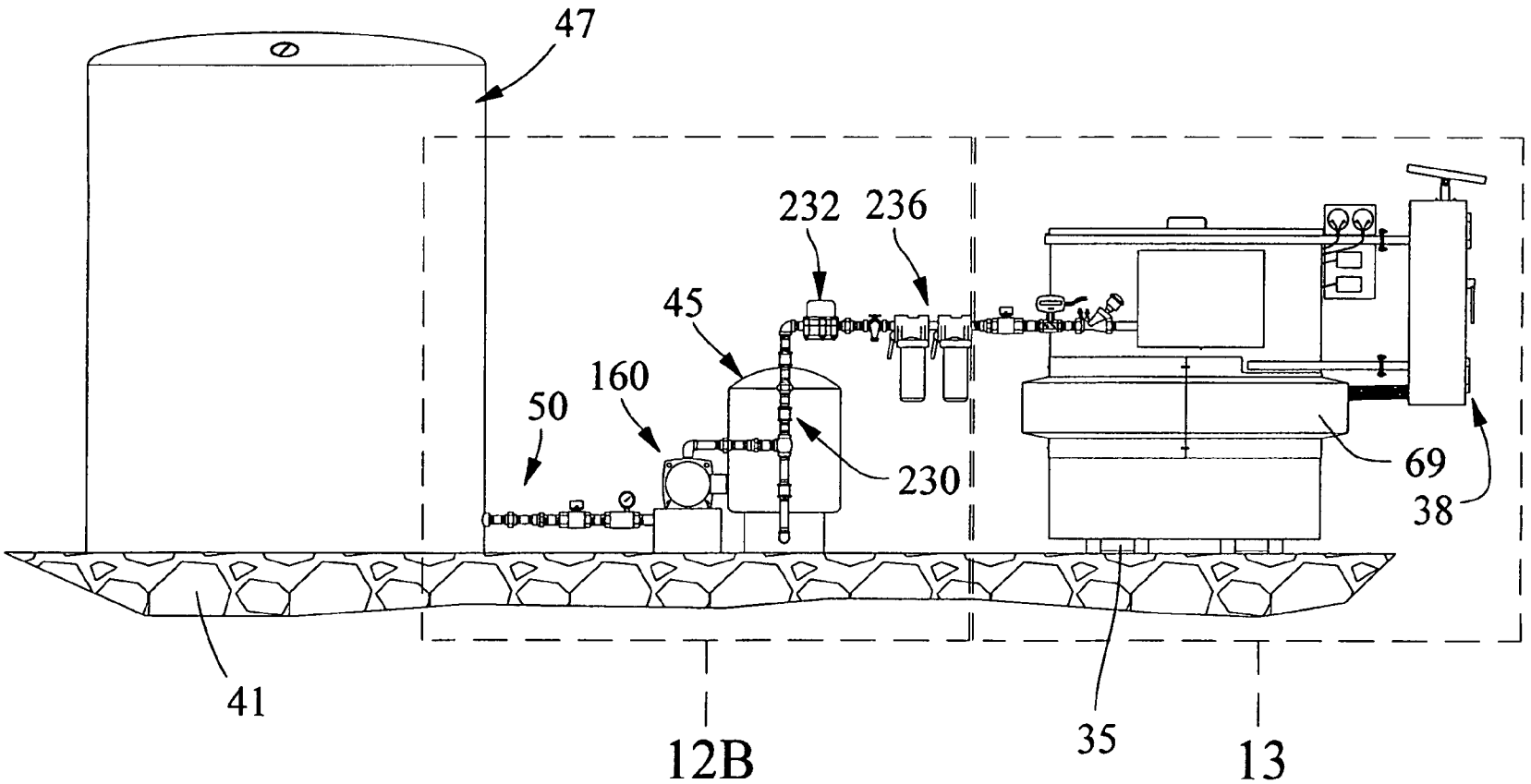
FIG. 12A is a pictorial view of a preferred overall system.
Figure 12B:
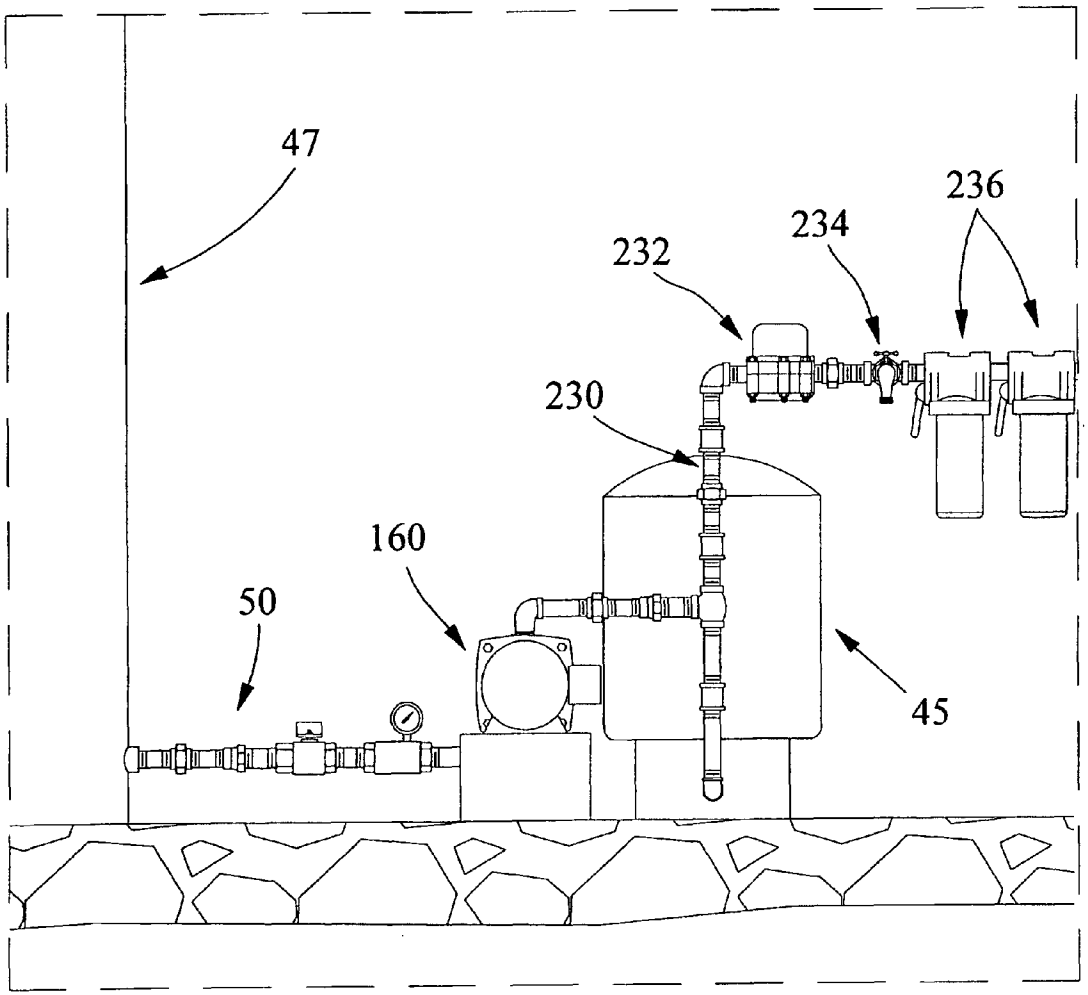
FIG. 12B is an enlarged view taken generally from rectangular, boldly numbered region 12B in FIG. 12A.
Figure 13:
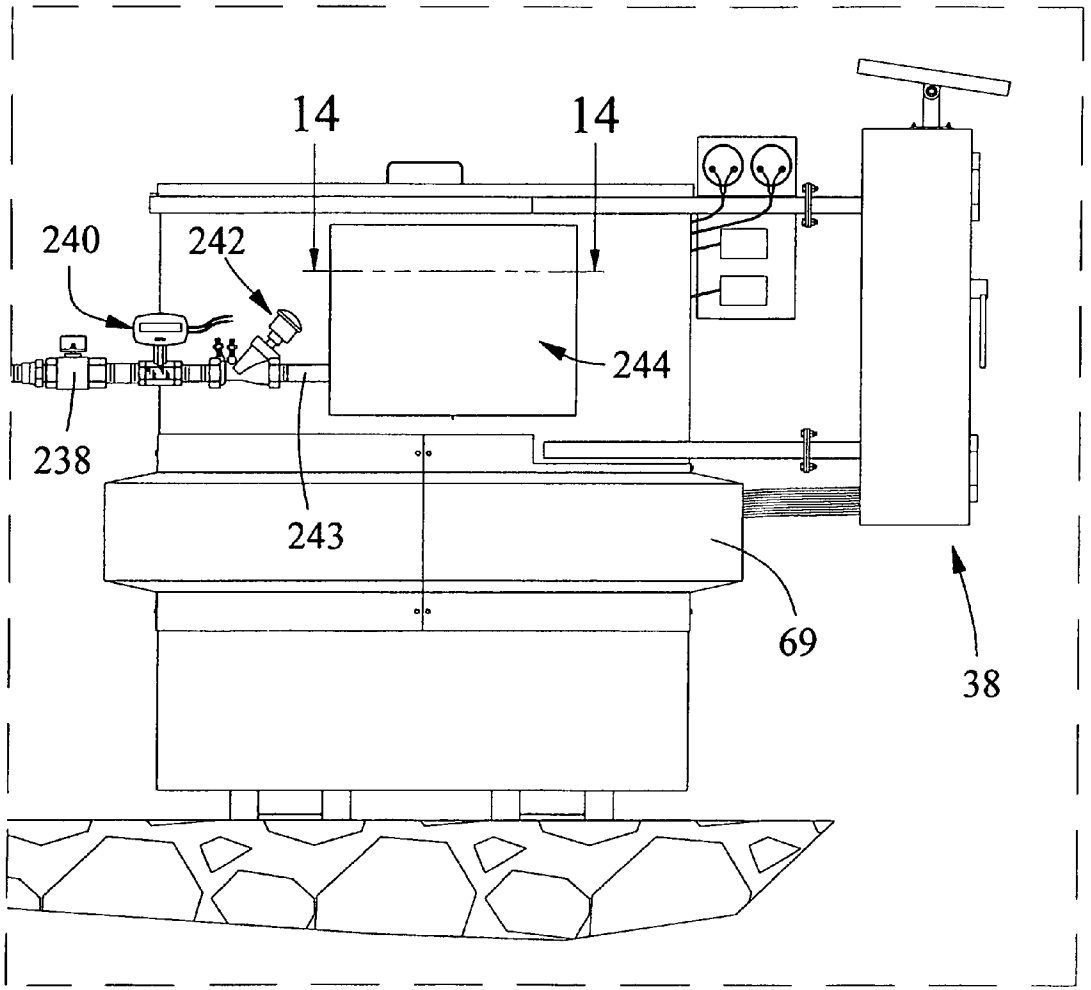
FIG. 13 is an enlarged view taken generally from rectangular, boldly numbered region 13 in FIG. 12A.

Details relating to the input water feed system are seen in FIGS. 12A, 12B, and 13. Water supplied from reservoir 47 is pumped into water supply tank 45 through pump 160. Water under a pressure head is accumulated within tank 45 and outputted though pipe 230 that is coupled to a pressure gauge 232 that leads to an in-line discharge fitting 234 (FIG. 12B) that leads to a pair of in-line, twist-on filters 236 that output to valve 238 (FIG. 13). Incoming, filtered source water is transmitted through a electronic sensor 240, coupling 242, and pipe 243 through manifold housing 244 (FIG. 14) to distribution manifold 246 that feeds all of the preferably six first stage steam tanks 37 (i.e., FIG. 4) previously discussed.

Figure 14:
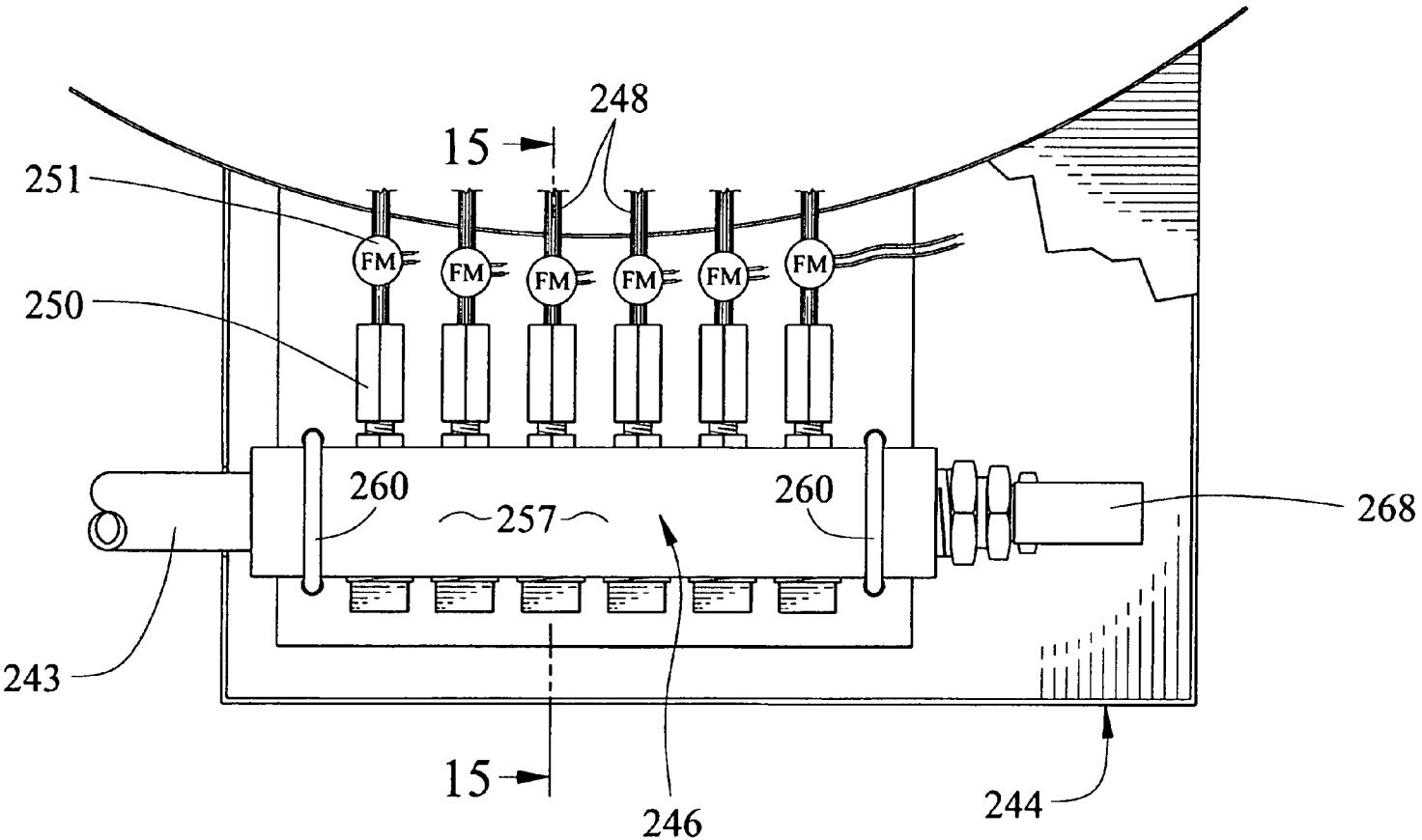
FIG. 14 is an enlarged sectional view taken generally along line 14-14 in FIG. 13, with portions thereof omitted for brevity.

In FIG. 14 there are six feed lines 248 extending to the various first stage steam tanks 37 through lines 166, 170 FIG. 3) discussed earlier. Each line 248 extends from a union 250 (FIGS. 14, 15) in turn coupled to a control fitting 252 that is centered within a recess 253. There are preferably six control fittings 252, one for each first stage steam tank, and all are in fluid flow communication with a manifold flow passageway 254 (FIG. 15) through flow restrictor nozzles 255 that are secured by flow restrictor fittings 256. Water outputted though feed lines 248 travels through bushing 249 and the flow rate is monitored by gauge 251 that communicates with electronics within the control console 38 via electrical lines 259.

Figure 15:
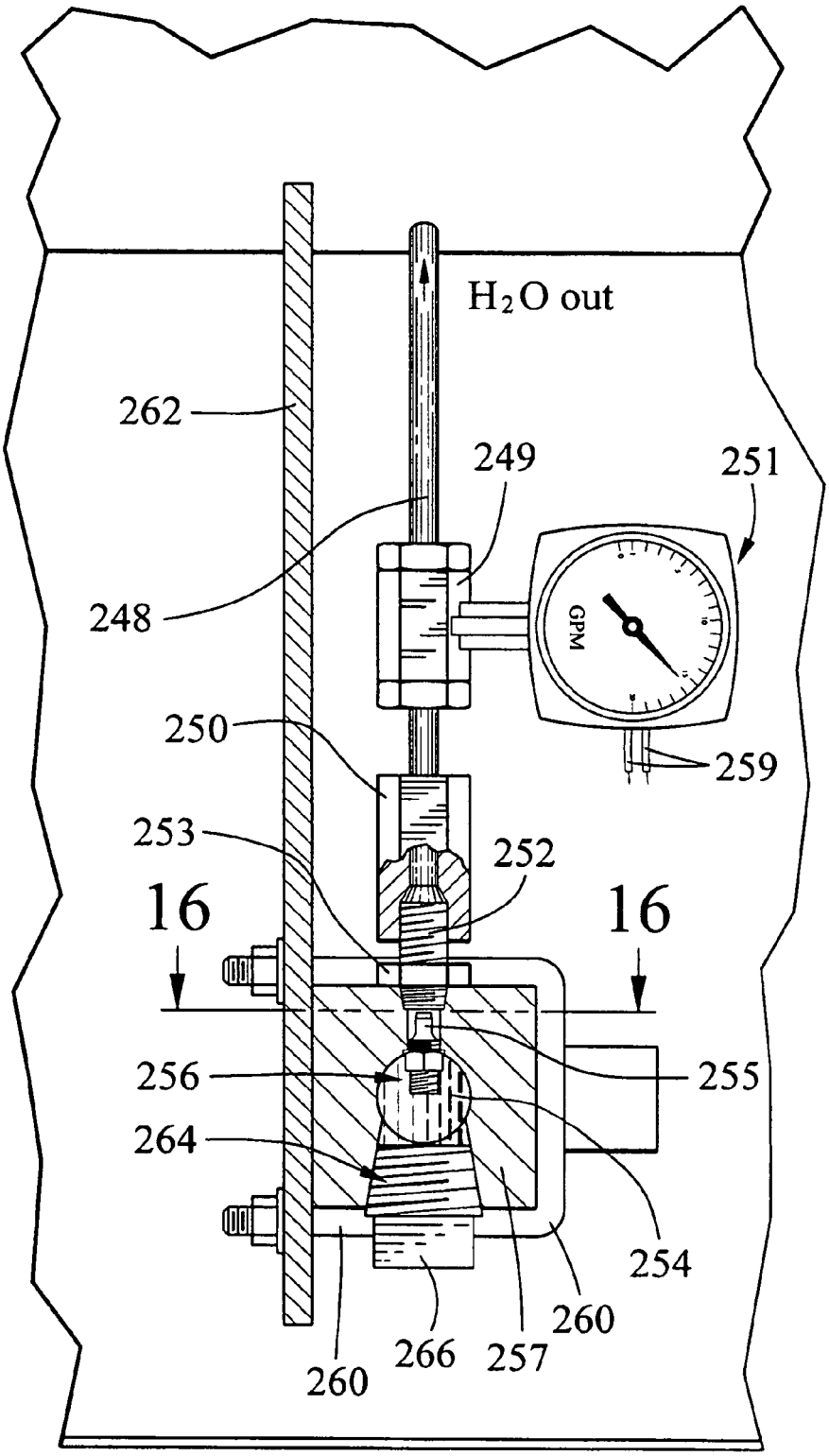
FIG. 15 is an enlarged, fragmentary sectional view taken generally along line 15-15 in FIG. 14, with portions thereof omitted for brevity.

The manifold 246 comprises a rigid block 257, generally in the form a parallelepiped that has a generally square cross section (i.e., FIGS. 14, 15). The pressurized, liquid bearing flow passageway 254 is generally coextensive with the length of block, and centered along the longitudinal axis thereof. A pressure gauge 268 (FIG. 14) monitors internal water pressure. Spaced apart U-clamps 260 secure manifold block 257 to a solid steel mounting plate 262. An inspection port 264 (FIG. 15) leading transversely through the manifold block 257 to flow passageway 254 is normally sealed by a lower plug 266.

Figure 16:
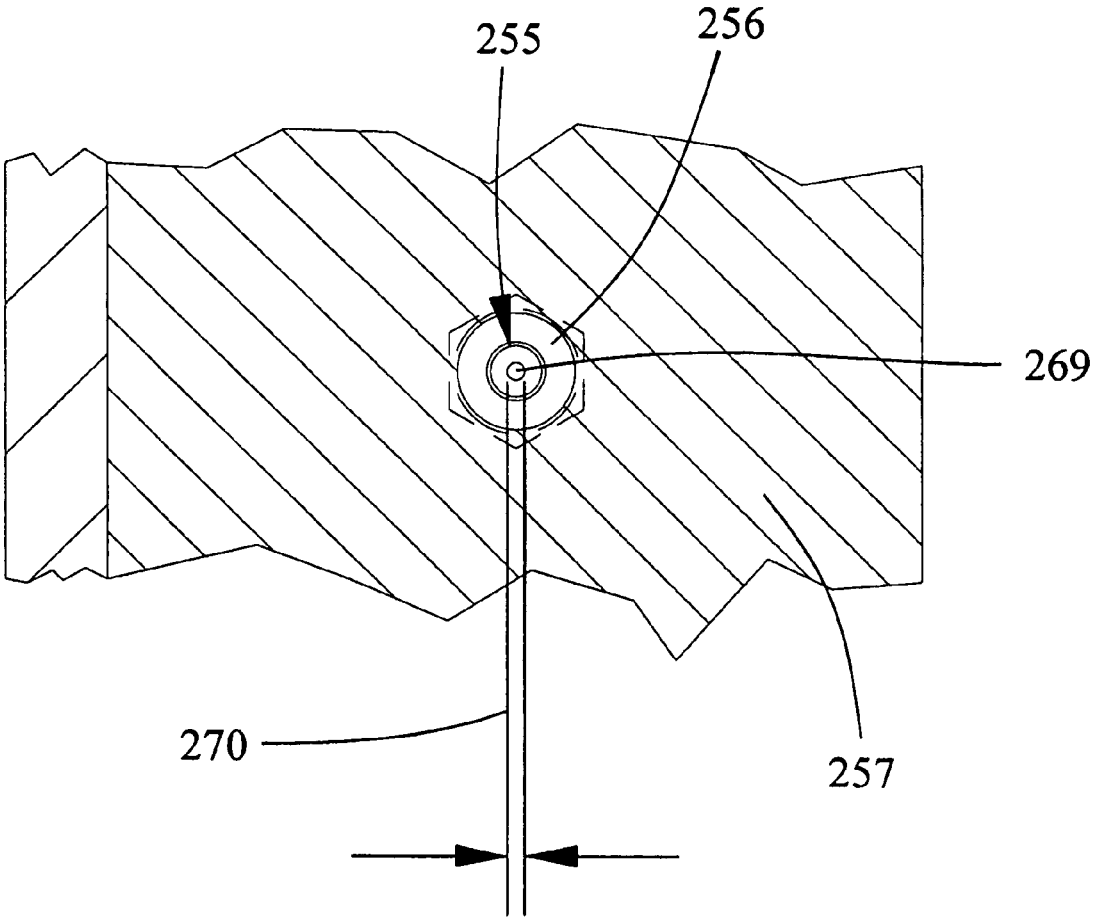
FIG. 16 is an enlarged, fragmentary sectional view taken generally along line 16-16 in FIG. 15, with portions thereof omitted for brevity.

Details of the flow reducer construction are seen in FIG. 16. The critical flow reducer fittings 256 are threaded into flow passageway 254 and thus secure the flow restriction nozzles 255 (FIGS. 15, 16). In FIG. 16, the end of a flow restrictor nozzle 255 is visible. The nozzle has an interior restriction passageway 269 that is critically dimensioned. As indicated by dimensioning reference lines 270. The diameter of the critical nozzle passageway is preferably 0.050 inches. This diameter, enlarged from that of U.S. Pat. No. 4,408,116, reliably outputs source water (actually low temperature steam at this point) to the steam tanks 37, and given the output pressure and pressure regulation of the supply tank 45 discussed earlier (i.e., FIG. 13). The output flow to each first stage steam tank 37, as monitored by its gauge 251 (FIG. 15) on each feed line 248, is preferably in the order of ten to thirty gallons per minute.

Figure 17:
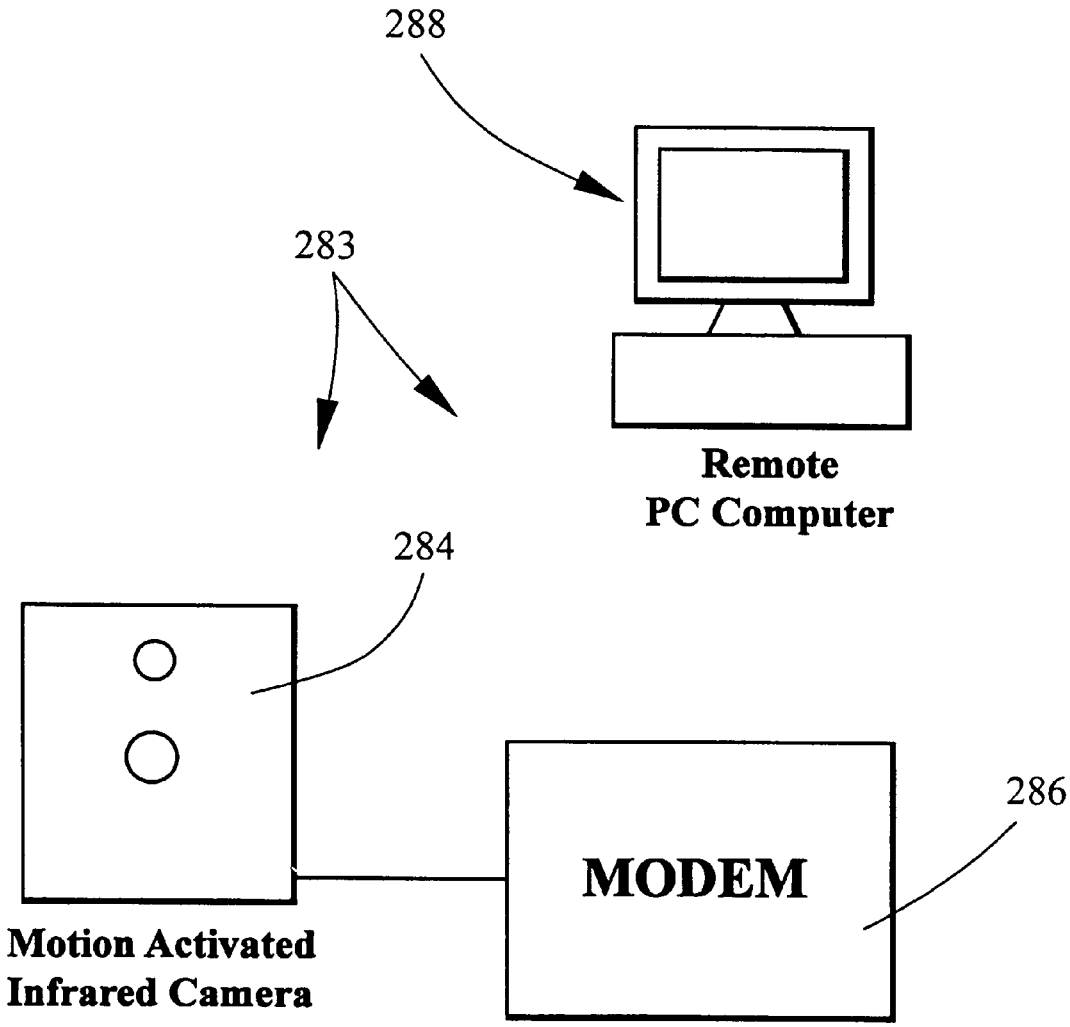
FIG. 17 is a block diagram of the preferred remote monitoring system.

FIG. 17 illustrates a preferred remote monitoring assembly 283 preferred with steam generators deployed in out-of-the way remote areas. A motion responsive, infrared monitoring camera 284 detects motion and intrusions to prevent possible vandalism. Video signals are transmitted via a modem 286, which communicates via phone lines or the interne. A remote video signal can be monitored on a conventional personal computer 288.

Figure 18:
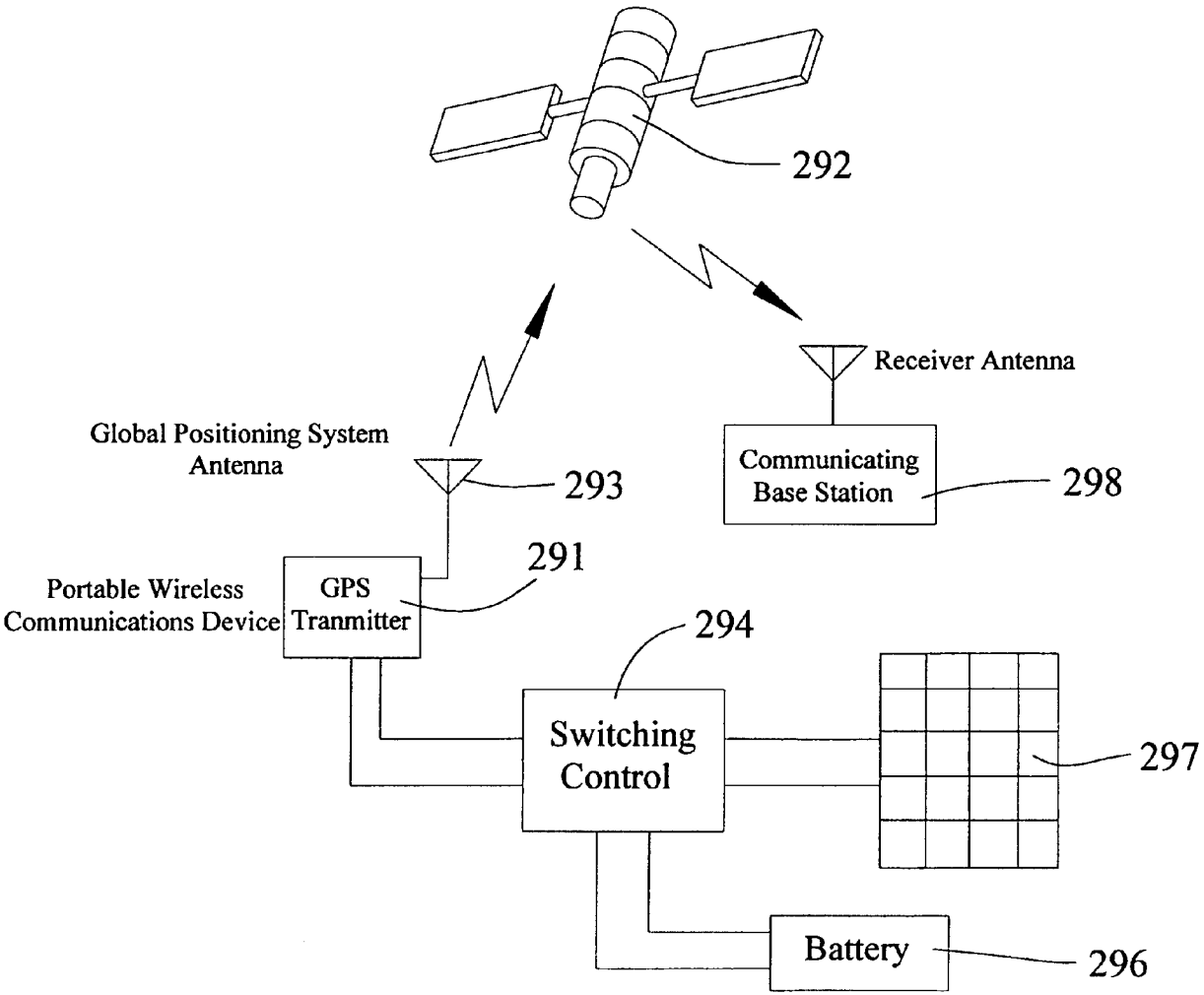
FIG. 18 is a block diagram of the preferred data-link communication system.

Referencing FIGS. 1 and 18, remote monitoring of system operating parameters can be enabled by a GPS transmitter 291 that feeds antenna 293 for relay, for example, to an overhead satellite. Operation is enabled by switching control 294 that is powered by a battery 296 and a solar panel 297. A remote monitoring station 298 can thus monitor operation parameters and collected data.

Figure 19:
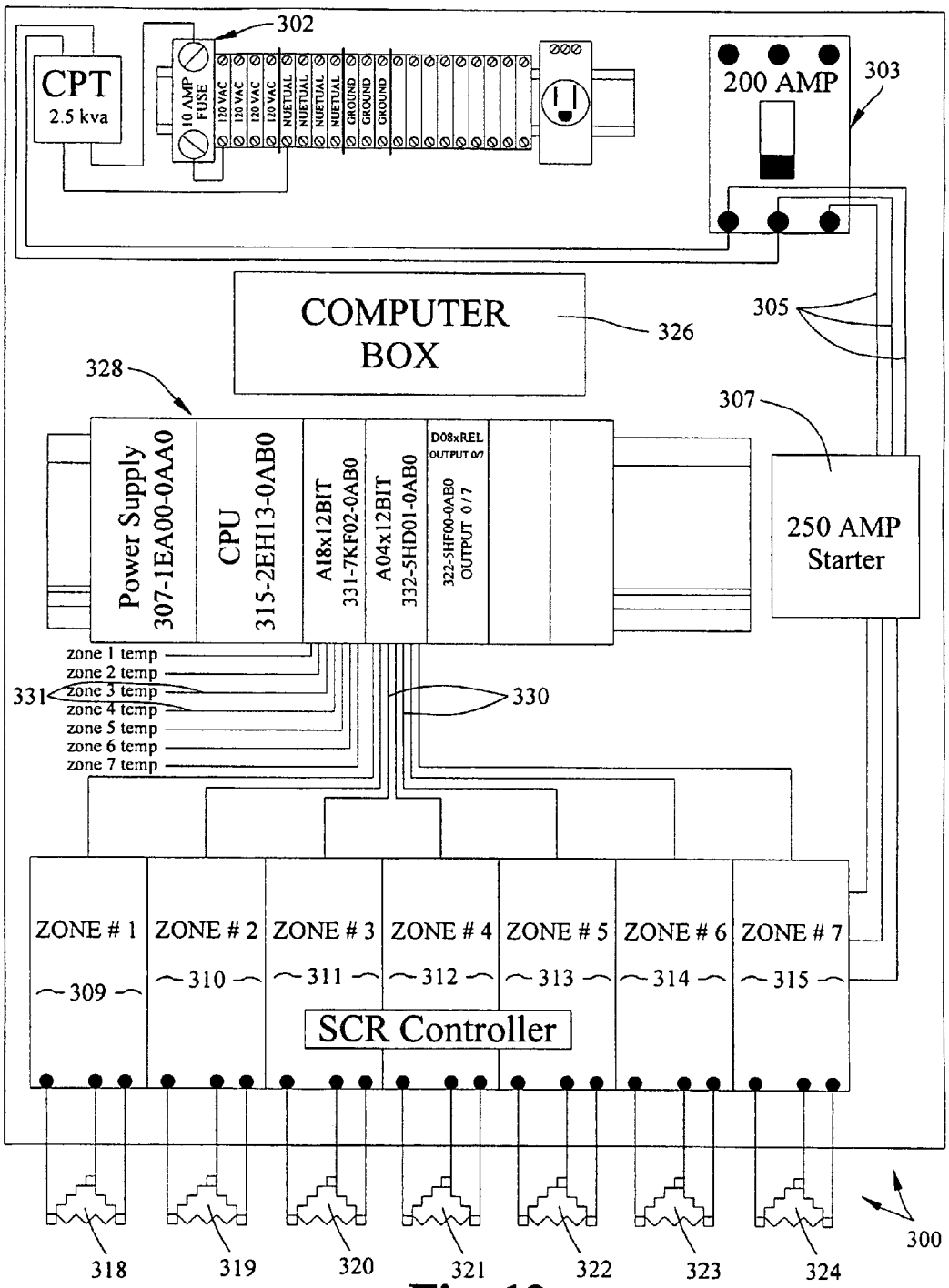
FIG. 19 is a pictorial view of the preferred electrical control box.
Figure 20:
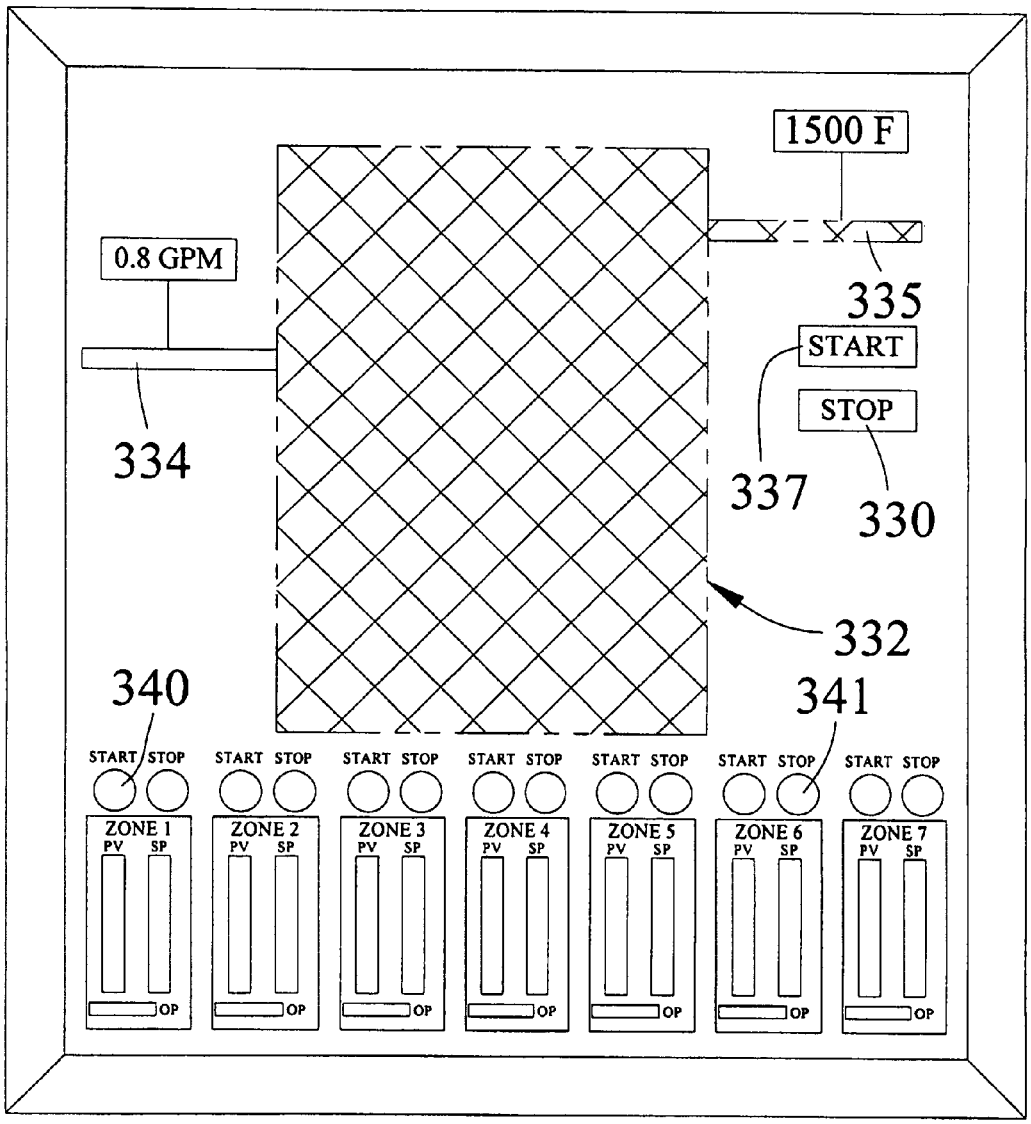
FIG. 20 is a plan view of the preferred controller panel and indicator screen.

FIG. 19 illustrates the electrical control 300 and critical wiring. Preferably three-phase, 480 volt A.C. power is supplied on site. Three phase electrical power is transmitted through fuses 302 and circuit breakers 303 along lines 305 through a starter 307 that provides current regulation during start-up to prevent excessive surge currents in the heaters. Power is transmitted to zone controllers 309-314 that power heating elements on the first stage steam tanks 37. The seventh zone control 315 controls heaters on the second stage steam tank 40. The three-phase resistive loads provided by the three heater elements on steam each tank are designated generally with the reference numerals 318-324. Power is applied with suitable silicon controlled semiconductors. The computer system 326 communicates through various circuit modules 328 that monitor electrical loads on lines 330 and operating temperatures via thermocouple lines 331.

The monitor screen 332 displays monitored parameters. For example, flow rates are indicated by bar 334, temperatures are monitored at bar 335. A start switch 337 and a stop switch 338 initialize and stop operation. Each zone can be independently switched on or off with start switches 340 and stop switches 341.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A superheated steam generator comprising:

an upright, containment vessel for protectively enclosing internal components;

a first stage heater comprising plurality of first stage steam tanks radially spaced apart about the periphery of a center, each first stage steam tank housed within a first stage casing, each first stage steam tank having a top, a bottom, and a cylindrical periphery;

first stage slack accommodating means for mounting each first stage steam tank within its corresponding first stage casing;

at least one serpentine, electric resistive heating element disposed within each first stage casing abutting at least a portion of said first stage steam tank bottom and periphery;

a liquid heat transfer medium disposed within each first stage casing for distributing heat in response to electric heating;

a steam tank shroud disposed concentrically within said containment vessel around said first stage heater;

a second stage heater comprising a second stage steam tank housed within a second stage casing, the second stage heater disposed within said shroud at said center, and said second stage heater surrounded by said first stage heater, the second stage steam tank housed within a second stage casing, the second stage steam tank having a top, a bottom, and a cylindrical periphery;

second stage slack accommodating means for mounting said second stage steam tank within said second stage casing;

at least one serpentine, electric resistive heating element within said second stage casing abutting at least a portion of said second stage steam tank bottom and periphery;

a liquid heat transfer medium disposed within said second stage casing for distributing heat in response to electric heating;

an annular region defined between said containment vessel and said steam tank shroud comprising insulation;

means for supplying water to said first stage steam tanks;

manifold means for conducting steam outputted by said first stage steam tanks to said second stage steam tank;

a discharge assembly for outputting superheated steam from said steam generator; and, means for conducting superheated steam outputted by said second stage heater to said discharge assembly.

2. The steam generator as defined in claim 1 wherein each of said first stage slack accommodating means and said second stage slack accommodating means comprises:

a downwardly projecting stub projecting from the bottom of each steam tank;

a rigid, tubular expansion socket secured beneath each steam tank that is aligned with said stub; and, wherein each stub is coaxially received within each corresponding socket and free to be displaced axially in response to thermal contraction and expansion.

3. The steam generator as defined in claim 2 wherein the containment vessel comprises a rigid, generally cylindrical, two piece body comprising upper and lower cylindrical segments that are joined together, and a removable cover disposed atop said containment vessel.

4. The steam generator as defined in claim 3 wherein the containment vessel comprises an external periphery and a generally toroidal guard circumscribing said periphery for protecting electrical lines, plumbing and miscellaneous and parts.

5. The steam generator as defined in claim 2 wherein the steam tank shroud comprises a rigid, generally cylindrical, two piece body comprising upper and lower cylindrical segments that are joined together, and a removable, insulated cover disposed atop said shroud.

6. The steam generator as defined in claim 2 wherein the first stage casings and the second stage casing touch one another to promote thermal efficiency.

7. The steam generator as defined in claim 6 wherein the first stage casings and the second stage casing have a hexagonal cross section.

8. The steam generator as defined in claim 2 wherein the first stage heater elements and the second stage heater elements flushly nest proximate the steam tanks for maximum heat transfer, and comprise at least one vertical portion proximate the periphery of adjacent steam tanks and inwardly deflected, arcuate bottom loops disposed adjacent the steam tank bottoms.

9. The steam generator as defined in claim 8 wherein the bottom loops of each of the heater elements have vertically upwardly extending portions abutting the steam tank peripheries and running to upper curved loops communicating with additional vertical portions.

10. A superheated steam generator comprising:

an upright, containment vessel for protectively enclosing internal components, the containment vessel comprising a rigid, generally cylindrical, two piece body comprising upper and lower cylindrical segments that are joined together, and a removable cover disposed atop said containment vessel;

a first stage heater comprising plurality of first stage steam tanks radially spaced apart about the periphery of a center, each first stage steam tank housed within a first stage casing, each first stage steam tank having a top, a bottom, and a cylindrical periphery;

means for flexibly mounting each first stage steam tank within its corresponding first stage casing;

at least one serpentine electric resistive heating element disposed within each first stage casing, each resistive heating element comprising a loop disposed adjacent the bottom of the adjacent first stage tank;

a liquid heat transfer medium disposed within each first stage casing for distributing heat in response to electric heating;

a steam tank shroud disposed concentrically within said containment vessel around said first stage heater;

a second stage heater comprising a second stage steam tank housed within a second stage casing, the second stage heater disposed within said shroud at said center, and said second stage heater surrounded by said first stage heater, the second stage steam tank housed within a second stage casing, the second stage steam tank having a top, a bottom, and a cylindrical periphery;

slack accommodating means for flexibly mounting said second stage steam tank within said second stage casing, said slack accommodating means comprising:

at least one serpentine electric resistive heating element within said second stage casing, each resistive heating element comprising a loop disposed adjacent the bottom of the second stage adjacent tank;

a liquid heat transfer medium disposed within said second stage casing for distributing heat in response to electric heating;

an annular region defined between said containment vessel and said steam tank shroud comprising insulation;

means for supplying water to said first stage steam tanks;

manifold means for conducting steam outputted by said first stage steam tanks to said second stage steam tank;

a discharge assembly for outputting superheated steam from said steam generator;

means for conducting superheated steam outputted by said second stage heater to said discharge assembly; and, wherein the first stage heater elements and the second stage heater elements flushly nest proximate the steam tanks for maximum heat transfer, and comprise at least one vertical portion proximate the periphery of adjacent steam tanks and inwardly deflected, arcuate bottom loops disposed adjacent the steam tank bottoms.

11. The steam generator as defined in claim 10 wherein the bottom loops of each of the heater elements have vertically upwardly extending portions abutting adjacent steam tank peripheries and running to upper curved loops communicating with additional vertical portions.

12. The steam generator as defined in claim 10 wherein the means for flexibly mounting each first stage steam tanks and the means for flexibly mounting said second stage steam tank comprise a slack accommodating mounting comprising:

a downwardly projecting stub projecting from the bottom of each steam tank;

a rigid, tubular expansion socket secured beneath each steam tank that is aligned with said stub; and, wherein each stub is coaxially received within each corresponding socket and free to be displaced axially in response to thermal contraction and expansion.

13. The steam generator as defined in claim 11 wherein the containment vessel comprises an external periphery and a generally toroidal guard circumscribing said periphery for protecting electrical lines, plumbing and miscellaneous and parts.

14. The steam generator as defined in claim 11 wherein the steam tank shroud comprises a rigid, generally cylindrical, two piece body comprising upper and lower cylindrical segments that are joined together, and a removable, insulated cover disposed atop said shroud.

15. The steam generator as defined in claim 11 wherein the first stage casings and the second stage casing have a hexagonal cross section.

16. The steam generator as defined in claim 11 wherein the first stage casings and the second stage casing touch one another to promote thermal efficiency.

17. A superheated steam generator comprising:

an upright, containment vessel for protectively enclosing internal components;

a first stage heater comprising plurality of first stage steam tanks radially spaced apart about the periphery of a center, each first stage steam tank housed within a first stage casing, each first stage steam tank having a top, a bottom, and a cylindrical periphery;

first stage slack accommodating means for mounting each first stage steam tank within its corresponding first stage casing;

at least one first stage serpentine, electric resistive heating element disposed within each first stage casing abutting at least a portion of said first stage steam tank bottom and periphery;

a liquid heat transfer medium disposed within each first stage casing for distributing heat in response to electric heating;

a steam tank shroud disposed concentrically within said containment vessel around said first stage heater;

a second stage heater comprising a second stage steam tank housed within a second stage casing, the second stage heater disposed within said shroud at said center, and said second stage heater surrounded by said first stage heater, the second stage steam tank housed within a second stage casing, the second stage steam tank having a top, a bottom, and a cylindrical periphery;

second stage slack accommodating means for mounting said second stage steam tank within said second stage casing;

at least one second stage serpentine, electric resistive heating element within said second stage casing abutting at least a portion of said second stage steam tank bottom and periphery;

a liquid heat transfer medium disposed within said second stage casing for distributing heat in response to electric heating;

an annular region defined between said containment vessel and said steam tank shroud comprising insulation;

means for supplying water to said first stage steam tanks;

manifold means for conducting steam outputted by said first stage steam tanks to said second stage steam tank;

a discharge assembly for outputting superheated steam from said steam generator;

means for conducting superheated steam outputted by said second stage heater to said discharge assembly; and, wherein each of said first stage slack accommodating means and said second stage slack accommodating means comprises a stub projecting downwardly from the bottom of each steam tank and a tubular expansion socket secured beneath each steam tank that is aligned with said stub and penetrated thereby, each stub free to be displaced axially in response to thermal contraction and expansion.

18. The steam generator as defined in claim 17 wherein the first stage heater elements and the second stage heater elements flushly nest proximate adjacent steam tanks for maximum heat transfer, and comprise at least one vertical portion proximate the periphery of adjacent steam tanks and inwardly deflected, arcuate bottom loops disposed adjacent the steam tank bottoms.

19. The steam generator as defined in claim 18 wherein the bottom loops of each of the heater elements have vertically upwardly extending portions abutting the steam tank peripheries and running to upper curved loops communicating with additional vertical portions.

20. The steam generator as defined in claim 19 wherein the containment vessel comprises a rigid, generally cylindrical, two piece body comprising upper and lower cylindrical segments that are joined together, and a removable cover disposed atop said containment vessel.

21. The steam generator as defined in claim 19 wherein the containment vessel comprises an external periphery and a generally toroidal guard circumscribing said periphery for protecting electrical lines, plumbing and miscellaneous and parts.

22. The steam generator as defined in claim 19 wherein the steam tank shroud comprises a rigid, generally cylindrical, two piece body comprising upper and lower cylindrical segments that are joined together, and a removable, insulated cover disposed atop said shroud.

23. The steam generator as defined in claim 19 wherein the first stage casings and the second stage casing touch one another to promote thermal efficiency.

24. The steam generator as defined in claim 23 wherein the first stage casings and the second stage casing have a hexagonal cross section.

* * * * *